US005411394A

United States Patent [19]

Beer et al.

[11] Patent Number: 5,411,394

[45] Date of Patent: May 2, 1995

[54] COMBUSTION SYSTEM FOR REDUCTION OF NITROGEN OXIDES

[75] Inventors: Janos M. Beer, Winchester, Mass.; Alessandro Marotta, Milan, Italy; Majed A. Toqan, Wellesley, Mass.

[73] Assignee: Massachusetts Institute of Technology, Cambridge, Mass.

[21] Appl. No.: 131,867

[22] Filed: Oct. 5, 1993

Related U.S. Application Data

[63] Continuation of Ser. No. 771,739, Oct. 4, 1991, abandoned, which is a continuation-in-part of Ser. No. 593,679, Oct. 5, 1990, abandoned.

[51] Int. Cl.[6] ..... F23D 1/00; F23D 11/00

[52] U.S. Cl. ..... 431/9; 431/115; 431/181; 431/182; 431/188; 431/10; 110/262; 110/264

[58] Field of Search ..... 431/284, 8, 9, 10, 181, 431/182, 187, 188, 115, 285; 110/261, 262, 265, 264

[56] References Cited

U.S. PATENT DOCUMENTS

| | | | |
|---|---|---|---|
| 2,515,845 | 7/1950 | Van Den Bussche . | |
| 3,030,773 | 4/1962 | Johnson . | |
| 3,576,384 | 4/1971 | Paczeli et al. . | |
| 4,270,895 | 6/1981 | Vatsky . | |
| 4,333,405 | 6/1982 | Michelfelder et al. | 110/265 X |
| 4,407,205 | 10/1983 | Beaufrere . | |
| 4,422,389 | 12/1983 | Schroder | 110/264 |
| 4,422,391 | 12/1983 | Izuha et al. . | |
| 4,466,363 | 8/1984 | Leikert et al. . | |
| 4,523,530 | 6/1985 | Kaminaka et al. . | |
| 4,539,918 | 9/1985 | Beer et al. . | |
| 4,545,307 | 10/1985 | Morita et al. . | |
| 4,604,052 | 8/1986 | Brown et al. . | |
| 4,718,359 | 1/1988 | Skoog | 431/184 X |
| 4,741,279 | 5/1988 | Azuhata et al. . | |
| 4,838,185 | 6/1989 | Flament . | |
| 4,845,940 | 7/1989 | Beer . | |
| 4,915,619 | 4/1990 | LaRue . | |
| 4,927,352 | 5/1990 | Chung | 431/184 |

FOREIGN PATENT DOCUMENTS

| | | | |
|---|---|---|---|
| 0174408 | 9/1985 | Japan | 431/9 |
| 0817383 | 3/1981 | U.S.S.R. | 110/265 |

OTHER PUBLICATIONS

Beer, J. M. et al., "Laminarization of Turbulent Flames in Rotating Environments", Combustion & Flame, vol. 16, 1971, pp. 39–45.

Emmons, H. W. et al., "The Fire Whirl", Eleventh Symposium on Combustion, The Combustion Institute, 1967, pp. 475–488.

Beer, J. M. et al., "Buoyant or Turbulent Jet Diffusion Flame in a Rotating Flow Environment", Malabar, Fla., 1983, pp. 136–146.

*Primary Examiner*—Carl D. Price

*Attorney, Agent, or Firm*—Fish & Richardson

[57] ABSTRACT

Low $NO_x$ burners for the combustion of gaseous, liquid and solid fuels. The fluid dynamic principle of radial stratification by the combustion of swirling flow and a strong radial gradient of the gas density in the transverse direction to the axis of flow rotation is used to damp turbulence near the burner and hence to increase the residence time of the fuel-rich pyrolyzing mixture before mixing with the rest of the combustion air to effect complete combustion.

46 Claims, 16 Drawing Sheets

| | % |
|---|---|
| PRIMARY AIR | 15.7 |
| SECONDARY AIR | 69.4 |
| TERTIARY AIR | 14.9 |

| | % | SWIRL NO. |
|---|---|---|
| PRIMARY AIR | 51 | 2.79 |
| SECONDARY AIR | 0 | - |
| TERTIARY AIR | 49 | 0.0 |

| | % | SWIRL NO. |
|---|---|---|
| PRIMARY AIR | 10 | 0.4 |
| SECONDARY AIR | 23 | 0.2 |
| TERTIARY AIR | 67 | 0.0 |

| | % | SWIRL NO. |
|---|---|---|
| PRIMARY AIR | 10 | 2.79 |
| SECONDARY AIR | 0 | - |
| TERTIARY AIR | 90 | 1.32 |

| | % | SWIRL NO. |
|---|---|---|
| PRIMARY AIR | 13 | 2.79 |
| SECONDARY AIR | 0 | - |
| TERTIARY AIR | 87 | 1.32 |

TEMPERATURE ISOTHERMS IN THE OPTIMUM NATURAL GAS FLAME

| | PERCENT OF FLOW | SWIRL NUMBER |
|---|---|---|
| PRIMARY | 19.3 | 2.79 |
| SECONDARY | 62 | .85 |
| TERTIARY | 18.7 | 0 |

DISTRIBUTION OF CH4 MOLE FRACTION IN THE OPTIMUM NATURAL GAS FLAME

RESULTS OF THE DETAILED MAPPING OF THE OPTIMUM FLAME:
OXYGEN CONC. (%)

NOx CONCENTRATION CONTOURS (in ppm)
(OPTIMUM FLAME MEASUREMENTS)

MODIFIED RICHARDSON NUMBER (Ri*) CONTOURS

COMBUSTION SYSTEM FOR REDUCTION OF NITROGEN OXIDES

CROSS REFERENCE TO RELATED APPLICATIONS

This is a continuation of application Ser. No. 07/771,739, filed Oct. 4, 1991, now abandoned, which is a continuation-in-part of U.S. Ser. No. 07/593,679, filed Oct. 5, 1990, now abandoned.

FIELD OF THE INVENTION

This invention relates to the reduction of nitrogen oxide emissions in combustion processes.

BACKGROUND OF THE INVENTION

Increasingly tight environmental regulations for $NO_x$ emission for coal-, oil- and gas-fired utility boilers are urging utility and industrial users of fossil fuels to pay greater attention to control of $NO_x$ in oil, coal and even gas-fired units. Effective control of $NO_x$ emissions requires the application of one or a combination of methods of combustion process modification including staged air and staged fuel injection, the use of low-$NO_x$ burners, and post-combustion clean-up such as $NH_3$ injection into combustion gases.

The most widely used design strategy for $NO_x$ reduction is staged combustion. Fuel-rich and -lean combustion zones in flames are created by "staging" the input of either air (overfire air) or fuel with injections positioned at selected axial points along the combustion stream.

In the case of "internal staging" processes, fuel-rich and -lean combustion zones are produced by appropriate mixing of the fuel and air introduced from a single burner stage, rather than by producing fuel-rich and -lean combustion zones using different axial stages (physically separated stages). Systems of this type employing multi-annular burner stages are used for example by Beér U.S. Pat. No. 4,845,940 and Beér et. al., U.S. Pat. No. 4,539,818.

The degree of $NO_x$ reduction achieved by these technologies has been observed to vary widely and to depend on the combustion system.

SUMMARY OF THE INVENTION

An object of the invention is to reduce the emission of $NO_x$ in the combustion of various fuels including natural gas, as well as those having bound nitrogen such as fuel oil and coal. The system is particularly useful in utility burners typically employing low excess air levels, e.g., less than about 25% excess air.

The reduction of $NO_x$ is achieved by the application of a fluid dynamic principle of combustion staging by radial stratification to prevent premature mixing of fuel and air. In the present invention, radial flame stratification is brought about by a combination of swirling burner air flow and a strong radial density gradient in the flame near the burner. Flow stratification has been demonstrated using various mechanical apparatus positioned about a flame for free burning fires and for a turbulent methane jet flame (see Emmons and Ying, Eleventh Symposium on Combustion, pp 475–88, The Combustion Institute (1967) and Beér et. al. *Combustion and Flame,* 1971, 16, 39–43, respectively). Generally, stratification as used herein is defined as the suppression of mixing of the fluid mass in a core region, typically the fuel-rich flame core in a burner application, with the surrounding fluid positioned around the core, typically air or recycled flue gas, by relative rotation of the air masses about the axis of the core, corresponding to the axis of the burner. The modified Richardson number is a dimensionless criterion for the quantitative characterization of the stratification (see Beer et. al., Supra.):

$$Ri^* = \frac{\frac{1}{\rho}\frac{\partial \rho}{\partial r} W^2/r}{\left(\frac{\partial U}{\partial r}\right)^2}$$

where $\rho$ is the density, W is angular momentum, r is radial distance from the axis and U is axial velocity. Ri* is the ratio of the rate of work required for transferring mass in a centrifugal force field with a radial density gradient, and the rate of work that goes into the production of turbulence. As used in the invention, stratification occurs at Richardson numbers above 0.04.

The flow and mixing pattern achieved with the invention consists of a fuel rich flame zone in the central region of the flame in which high temperature pyrolysis reactions can take place. This flame core is preserved by the radial stratification from premature mixing with the rest of the combustion air introduced around the fuel rich flame core. Preferably, the stratification prevents substantial mixing in the regions of the flame having a temperature of about 1700K or greater. The residual fuel is then burned in cooler, highly turbulent flame zones positioned either downstream of the stratified pyrolysis zones or around it in a toroidal vortex (e.g., FIG. 2). The radially stratified flame core produces a highly stable flame which has the advantage that the flame tolerates significant depletion of the $O_2$ concentration in the combustion air—brought about by the admixing of flue gas, without the risk of losing flame. The increase in stability results in an increase in the blow-off limits as a consequence of increasing rate of rotation of the airflow. Schlieren photographs of a free, initially turbulent methane jet burning in air show that the rotation of the air around the jet laminarizes the flow, with the effect of reducing jet entrainment and hence producing a lengthened fuel rich flame core.

In the adaptation of the principle of radial stratification to the design of a low $NO_x$ burner the reduction of fuel/air mixing within the flame core serves to increase the residence time in the hot fuel rich (oxygen depleted) pyrolysis region of the core which reduces the synthesis of $NO_x$ in the stratified zone. The improved flame stability brought about by stratification, increases the tolerance for the use of oxygen depleted combustion air (by e.g., recirculation of flue gas). The final fuel burn-out occurs further downstream of the burner where an internal recirculation zone develops due to vortex breakdown in the swirling flow under low oxygen conditions that also inhibit $NO_x$ production. Thus, an aspect of the invention is that, with stratification as taught herein, a stable flame may be produced with a highly fuel rich region near the core substantially isolated from the surrounding oxidant. Further isolation from the oxidant is achieved by recirculation of low oxygen gas from the effluent.

In preferred embodiments, the burner is an internal stage system with a single insertion region, i.e., all gas and fuel flows are introduced to the combustion chamber from a single position upstream of combustion. The burner consists of a burner face with a central fuel gun surrounded by three annular air nozzles. Both the distribution of the air flow and degree of air swirl are controlled independently in the three annuli to optimize stratification. The degree of air swirl is characterized by the swirl number which is the normalized ratio of the angular and linear momenta of the flow. The highly flexible burner permits the variation of fuel mixing history, both radially and axially, over wide ranges. The system enables, for example, $NO_x$ reduction of about 88% (e.g. from 240 ppm to less than 30 ppm, e.g. 15 ppm) by varying fuel-air mixing in a manner that stratifies the flame radially in the near field of the burner but permits full mixing further downstream to yield complete combustion with low oxygen (e.g. 2% $O_2$) in the stack.

The invention features method and apparatus for reducing $NO_x$ emissions from combustion of fuels. A single stage burner is provided having a fuel gun arranged on a burner axis, a first concentric nondivergent nozzle, second concentric nondivergent nozzle and third concentric nondivergent nozzle. Each successive nozzle is arranged at increasing radii from said axis. A combustible mixture is flowed through said fuel gun to form a combustible core flow of said mixture along said axis and first, second and third successively concentric flows of gas are provided through said first, second and third concentric nozzles. The core flow is combusted in a combustion chamber and said concentric flows and said core flow are stratified by separately controlling the tangential swirl of said concentric flows to form a Rankine vortex.

In various preferred embodiments, the invention may include one or more of the following features. The first concentric flow has a swirl equal to or more than said core flow, second concentric flow has a swirl equal to or less than the swirl of said first concentric flow and said third concentric flow has a swirl equal or less than said second concentric flow. The concentric and core flows are stratified to have a Richardson number of about 0.04 or greater to induce a region in which turbulence is damped in said core. The primary gas flow is about 10 to 30% of the total concentric flow with a swirl number of about 0.6 or greater, the secondary gas flow of about 10 to 30% of the total concentric flow with a swirl number of about 0.6 or greater, and the tertiary gas flow of about 40 to 80% of the total concentric flow with a swirl number in the range of about 1.5 or less. The primary gas flow of about 10% of the total flow with a swirl number of about 0.6 or higher, the secondary gas flow of about 10% of the total flow with a swirl number of about 0.60 or higher, and the tertiary gas flow of about 80% of the total flow with a swirl number of about 1.5 or less. Flue gas from said combustion is recirculated by providing said flue gas to said concentric nozzles. About 50% or less of said flue gas is recirculated through said concentric nozzles. Steam is provided to said core flow. The steam is about 25% or less of said core flow. The stratifying is controlled to limit substantial mixing of said concentric and core flows in the regions of said core flow having a temperature of about 1700K or greater. The flows are controlled to induce mixing of said concentric and core flows downstream of stratified region of said core flow having a temperature of about 1700K or greater. The fuel is selected from gaseous fuels, coal and fuel oils.

Other features, aspects and advantages follow.

DESCRIPTION OF THE PREFERRED EMBODIMENT

We first briefly describe the drawing.

FIG. 1 is a cross-sectional schematic of a burner according to the invention;

FIG. 1*a* is a front view of the burner of FIG. 1;

FIGS. 1*b–d* are expanded end views of the fuel gun nozzle apparatus' employed in the burner of FIG. 1 for various fuels;

FIG. 2 is a schematic of the burner in FIG. 1 that illustrates gas flows produced by the burner when operated in a preferred configuration, while

Figure 3:
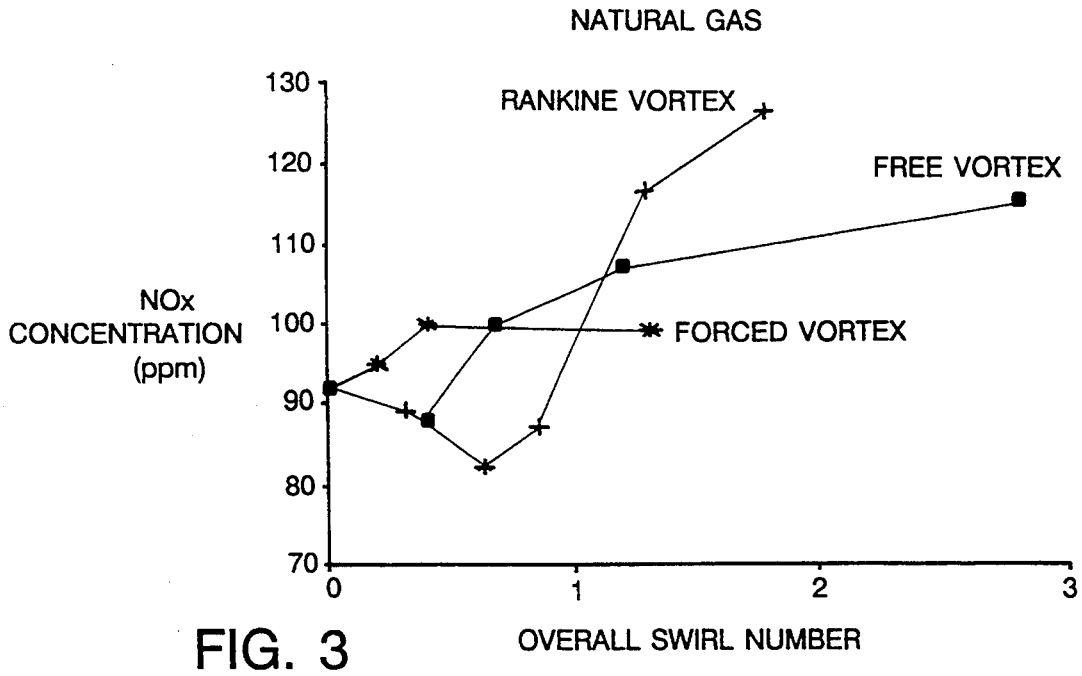
FIG. 3 is a graph illustrating the effect of overall swirl number on the $NO_x$ concentrations.
Figure 3A:
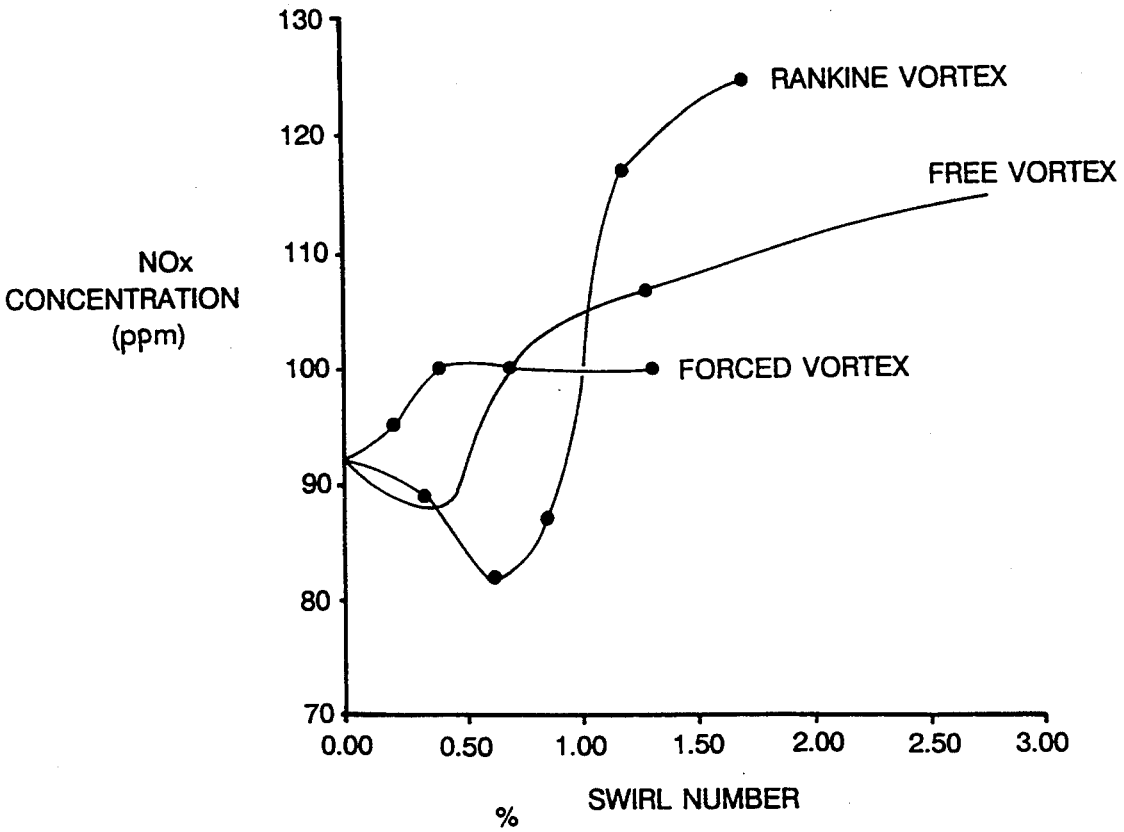
Figure 3B:
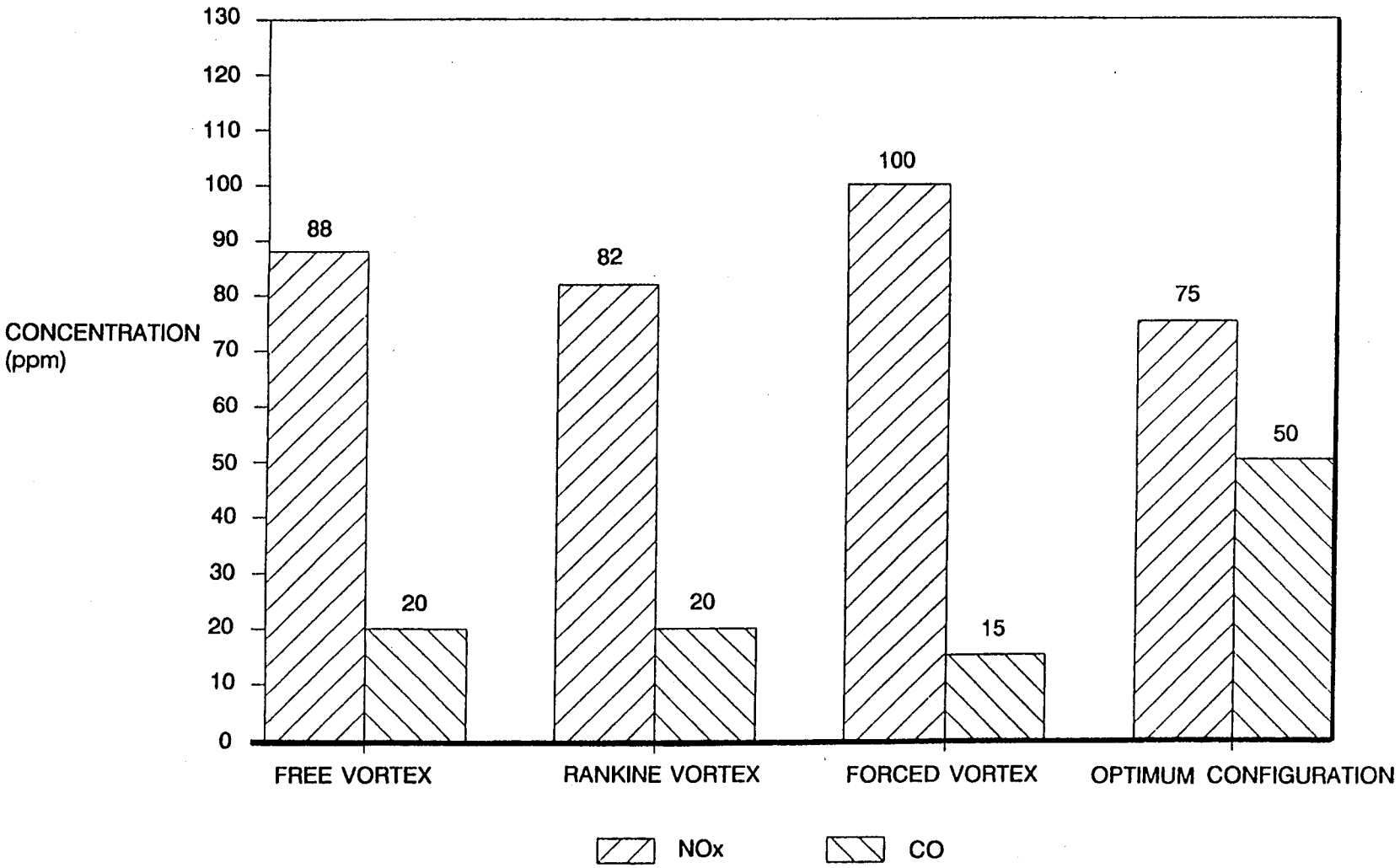
Figure 4:
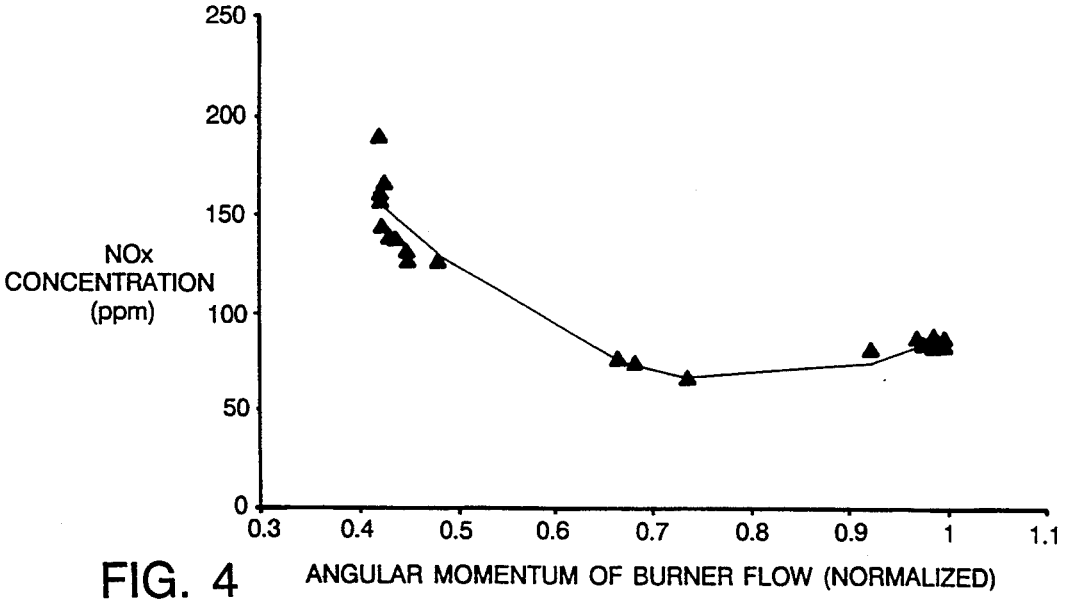
Figure 5:
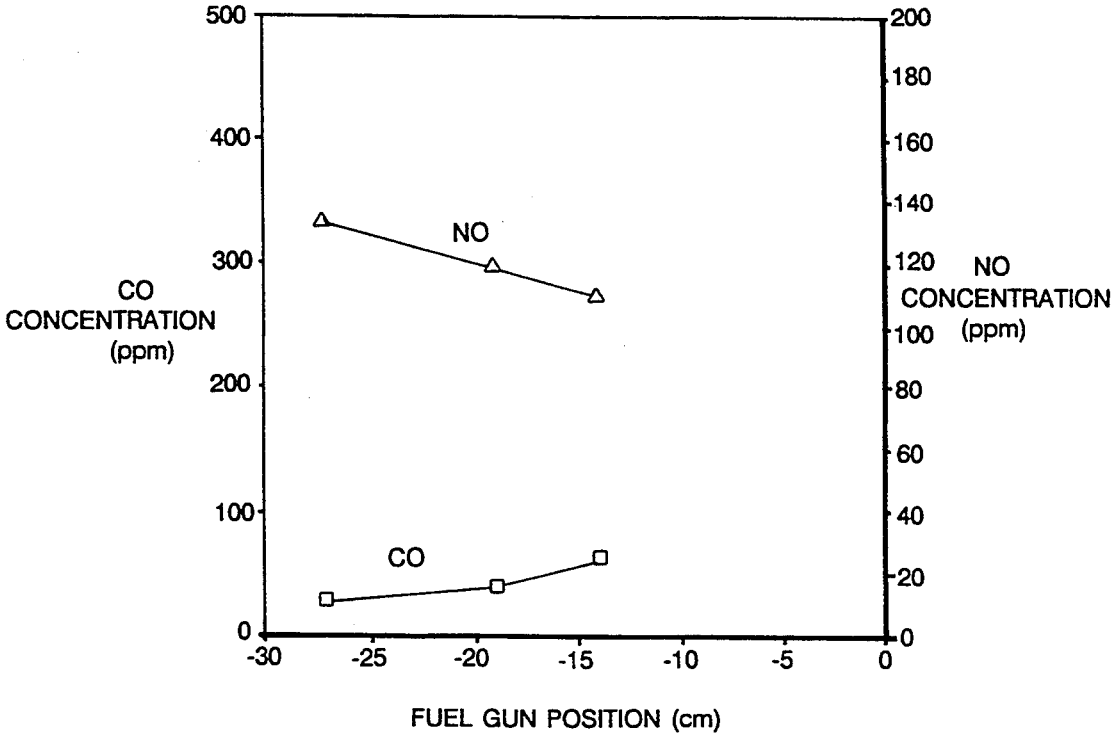
Figure 6:
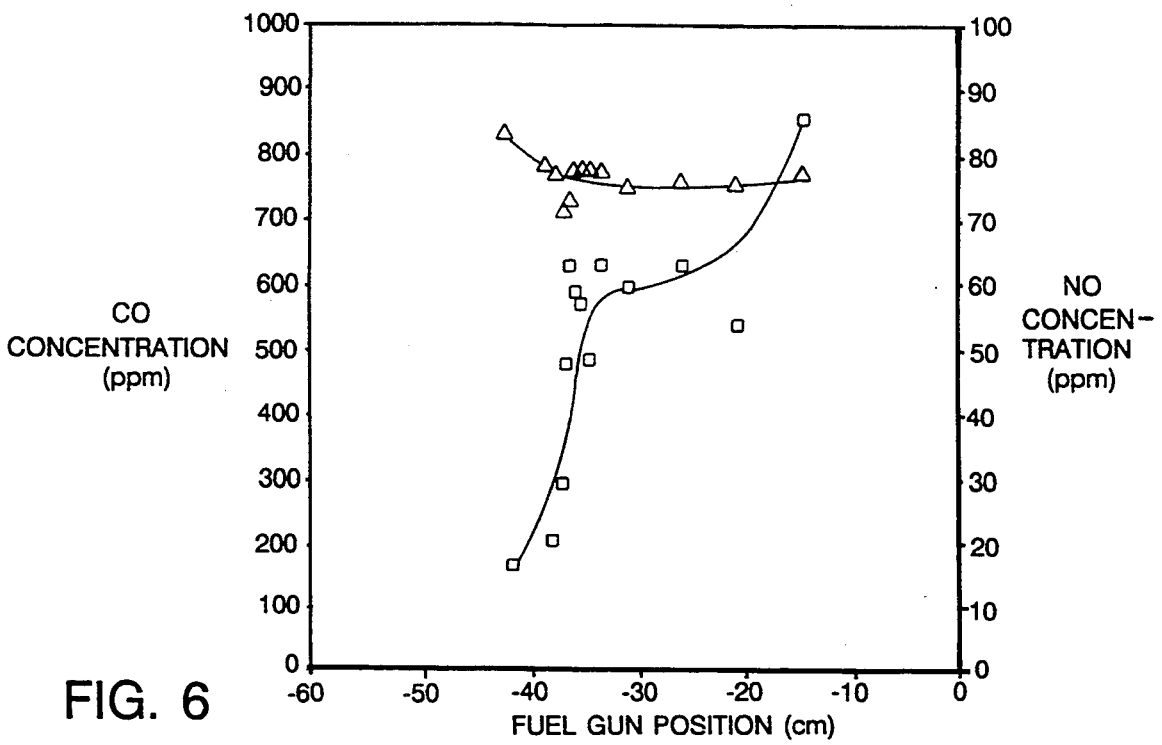
Figure 7:
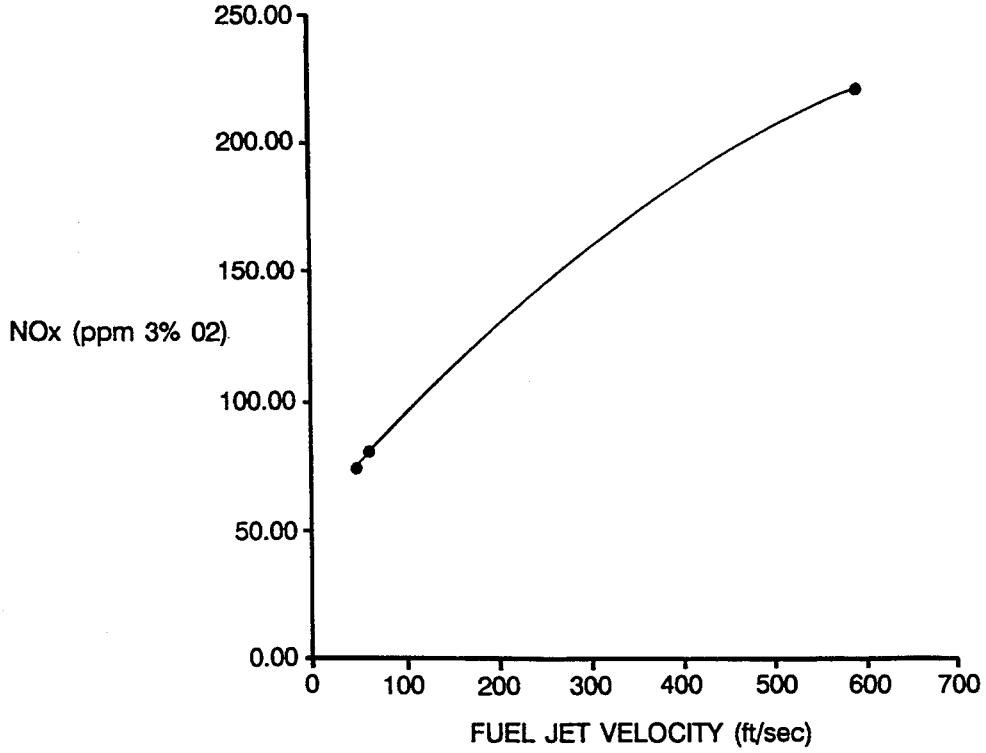
Figure 7A:
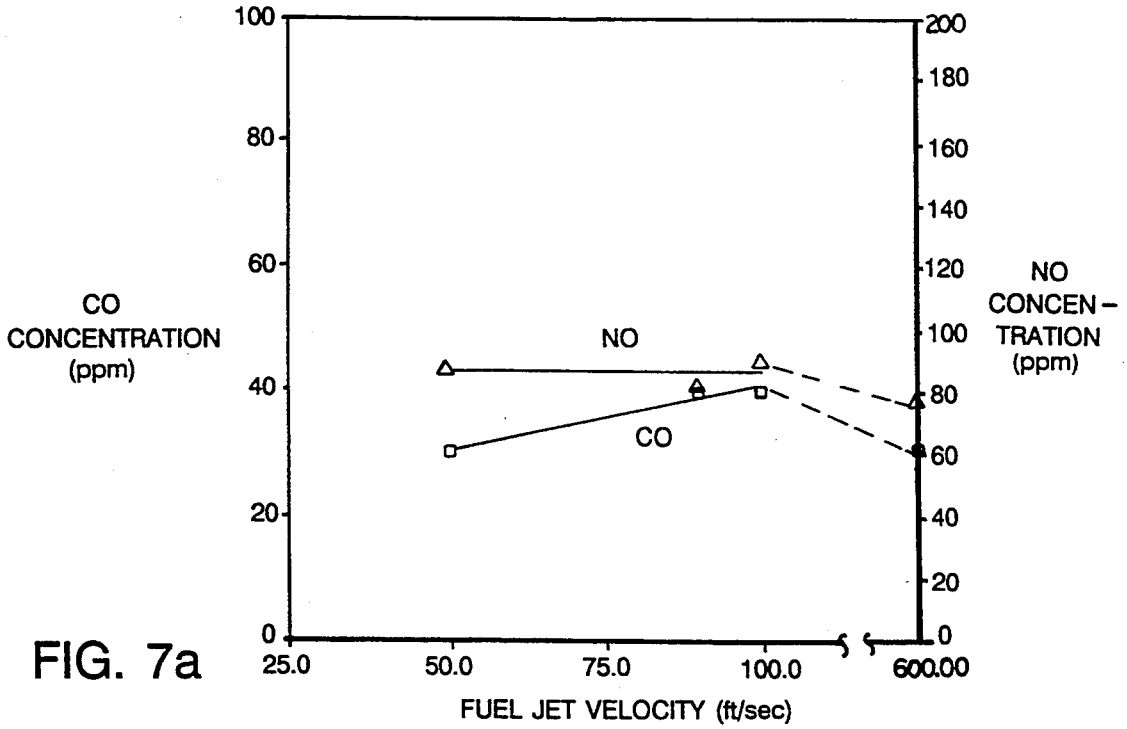
Figure 8:
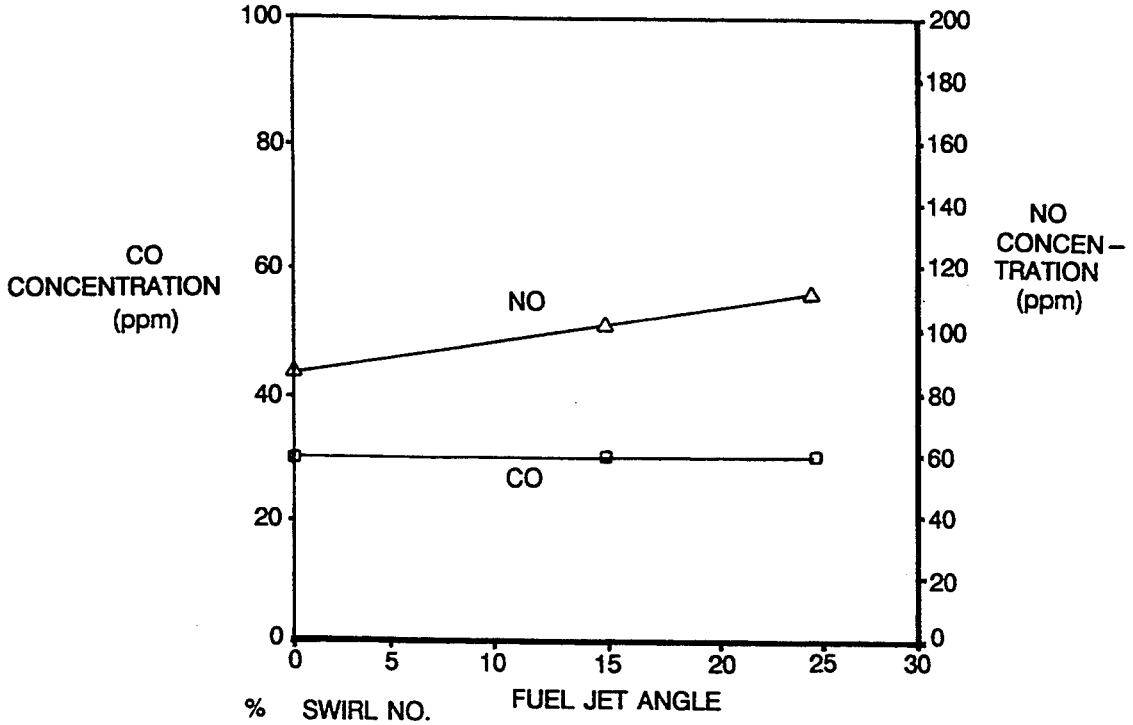
Figure 9:
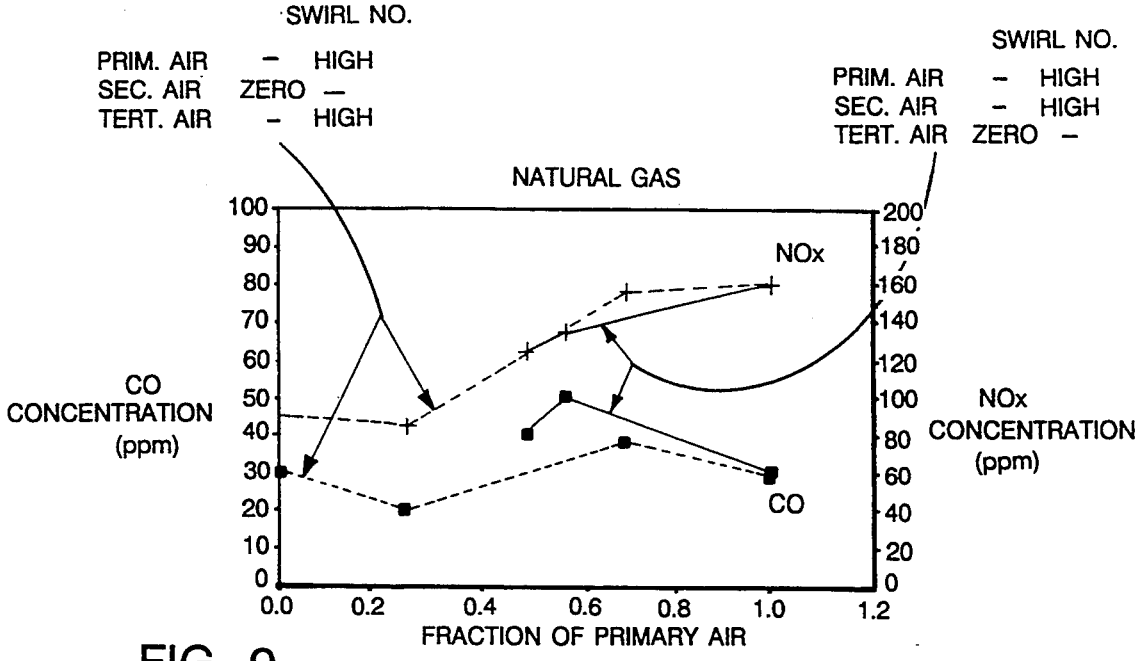
Figure 10:
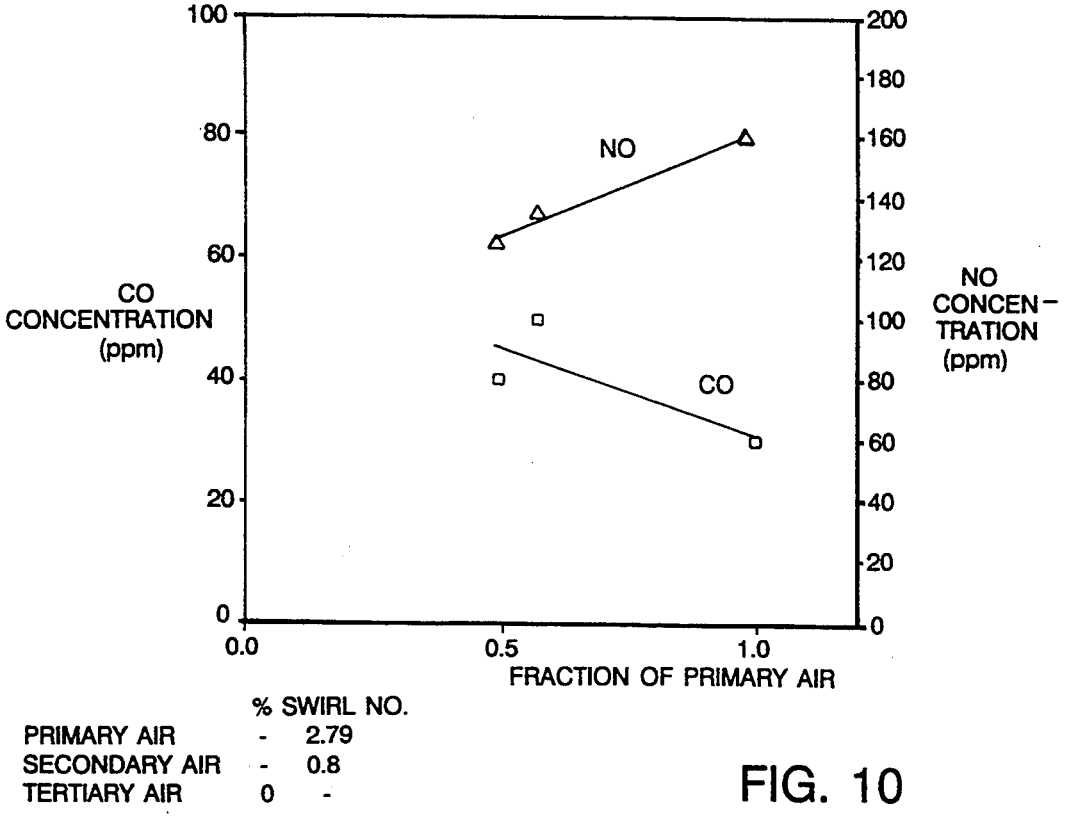
Figure 11:
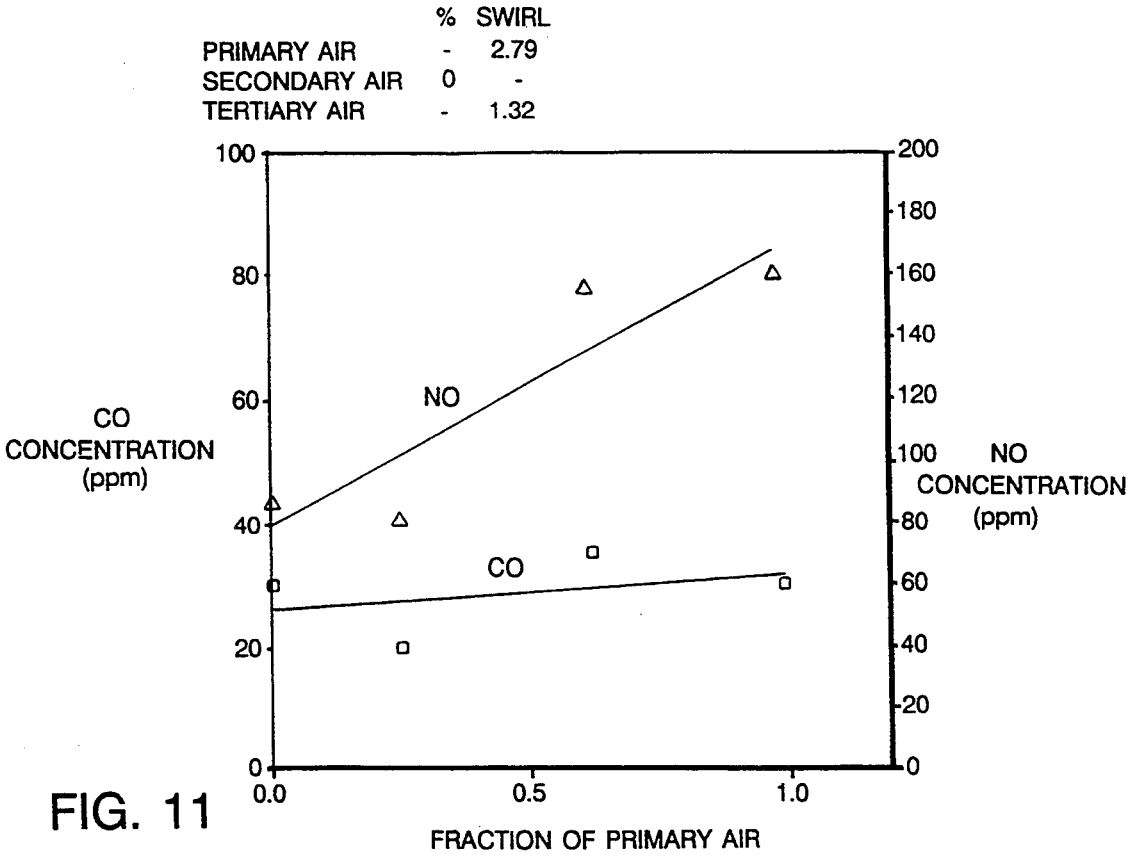
Figure 12:
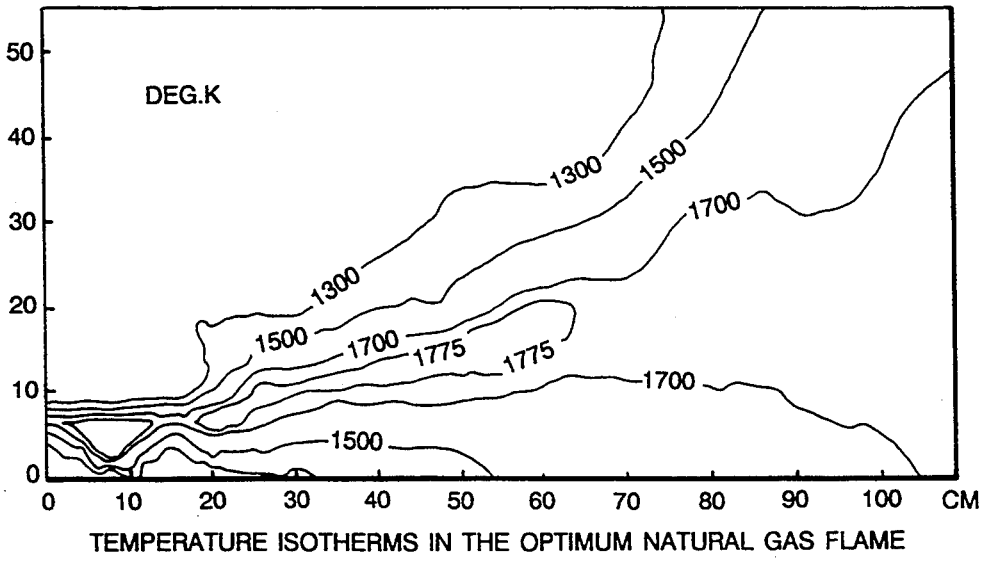
Figure 12A:
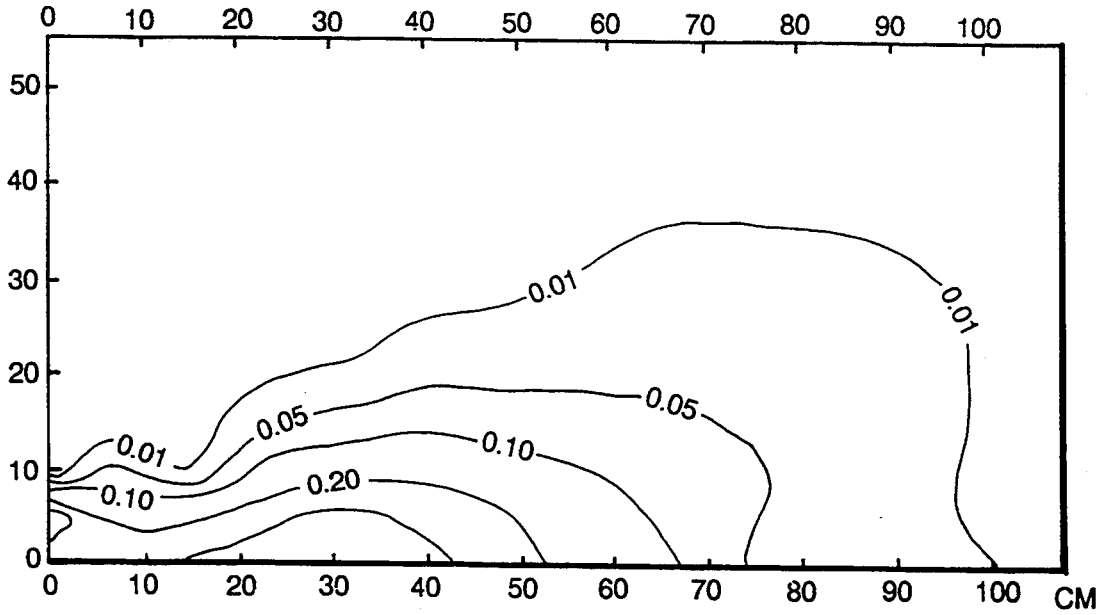
Figure 12B:
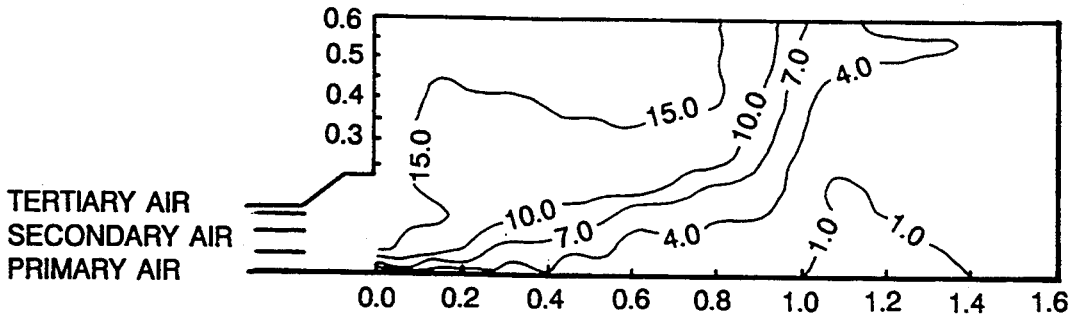
Figure 12C:
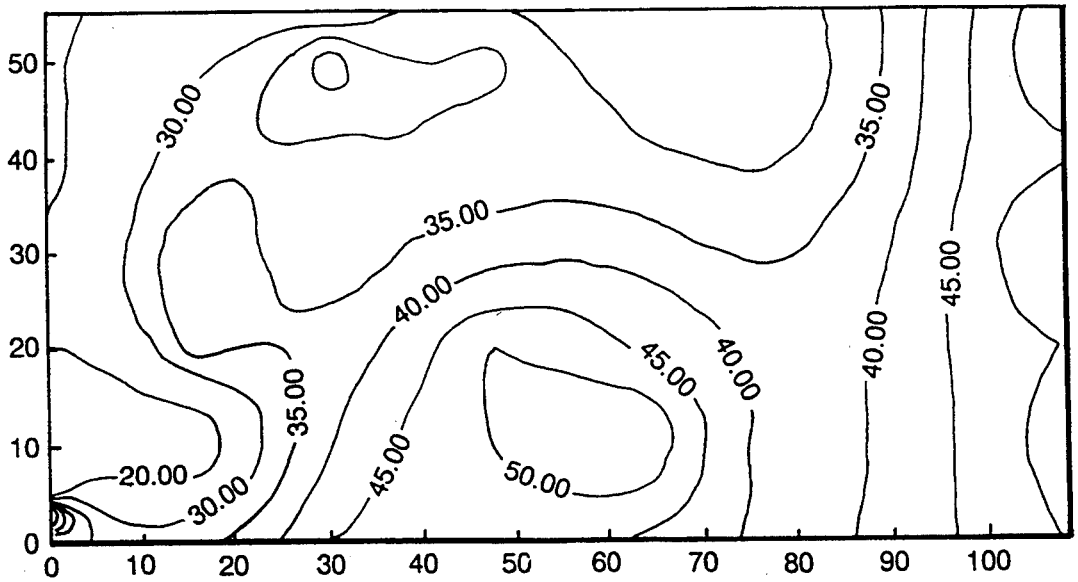
Figure 12D:
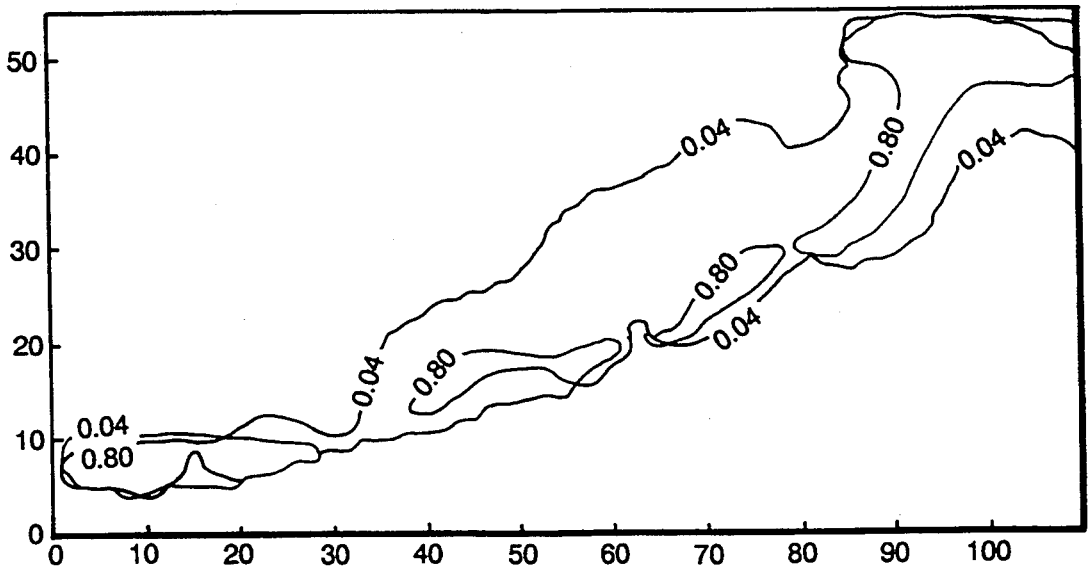
Figure 13:
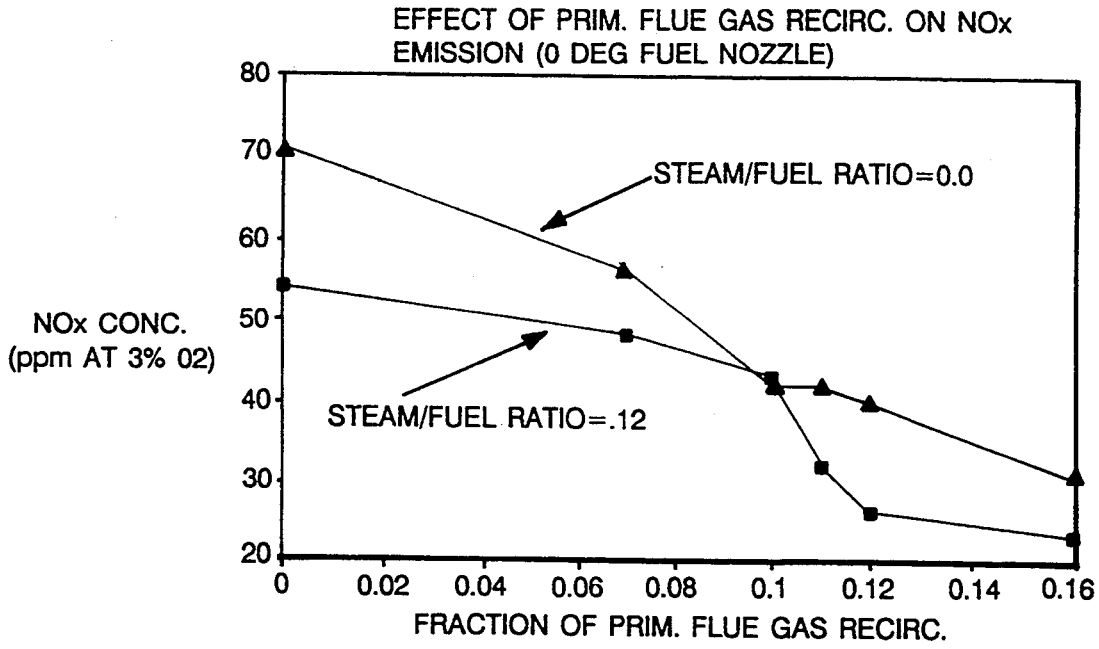
Figure 14:
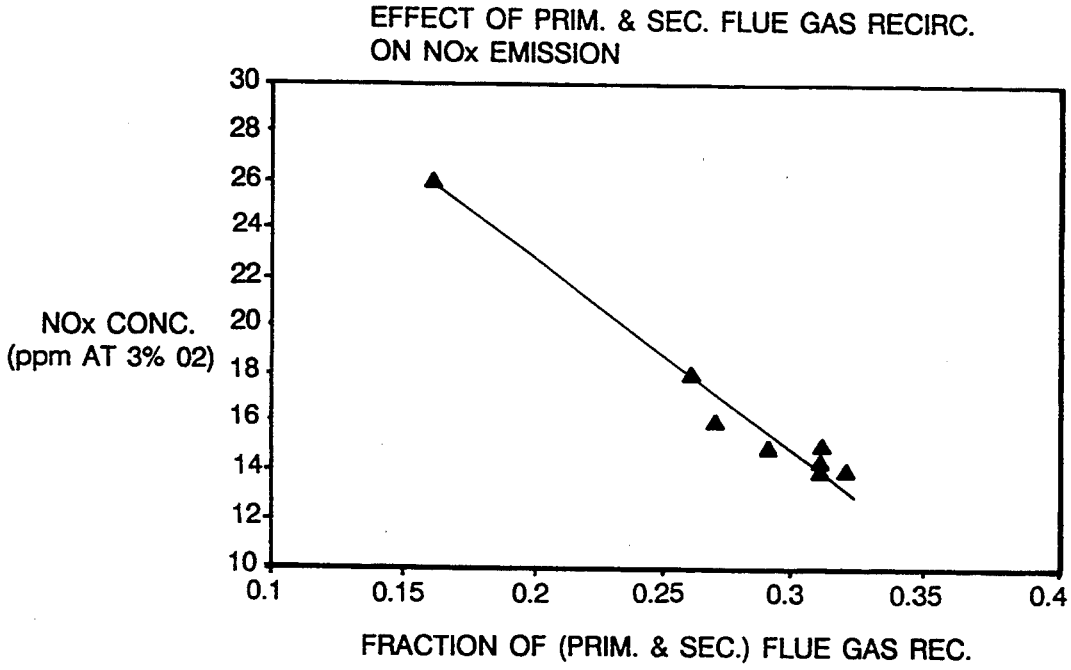
Figure 15:
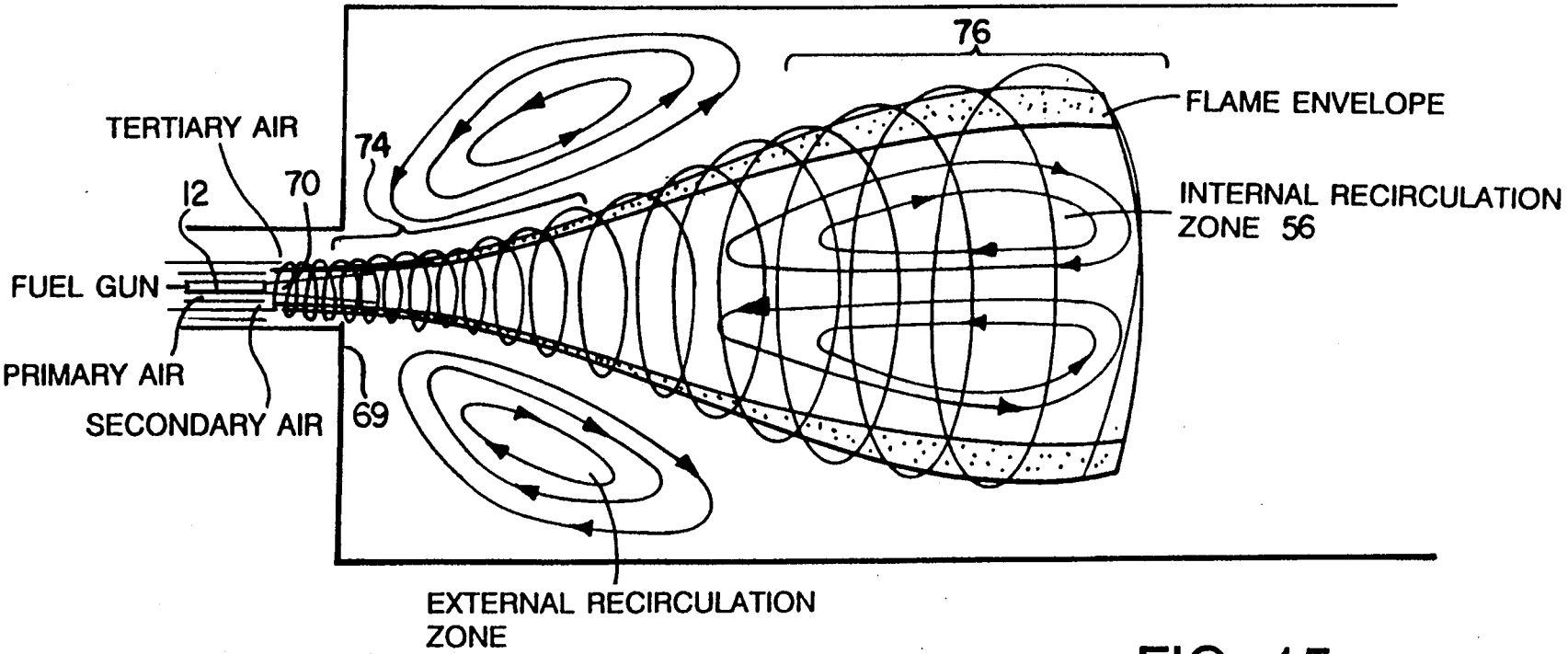

FIG. 3*a* is a graph illustrating the effect of the type of vortex produced by the burner upon $NO_x$ concentration is the flue gas, while FIG. 3*b* is a graph comparing the $NO_x$ production of an optimized swirl configuration to the best-case vortices of FIG. 3;

FIG. 4 is a graph illustrating the effect of the normalized angular momentum on $NO_x$ concentration;

FIG. 5 is a graph illustrating the effect of fuel gun position on NO and CO concentrations as measured at the exit (excess $O_2=1.5\%$) of a combustion tunnel;

FIG. 6 is a graph illustrating the effect of fuel gun position upon the NO and CO concentrations as measured at the exit (excess $O_2=1.5\%$) of a combustion tunnel;

FIG. 7 and FIG. 7*a* are graphs illustrating the effect of fuel jet velocity on NO and CO (FIG. 7*a* only) concentrations as measured at the exit (excess $O_2=1.5\%$) of a combustion tunnel;

FIG. 8 is a graph illustrating the effect of fuel jet angle on NO and CO concentration as measured at the exit (excess $O_2=1.5\%$) of a combustion tunnel;

FIG. 9 is a graph illustrating the effect of the fraction of primary air on CO and $NO_x$ concentrations;

FIG. 10 is a graph illustrating the effect of the ratio of primary air/secondary air on NO and CO concentrations as measured at the exit (excess $O_2=1.5\%$) of the combustion tunnel;

FIG. 11 is a graph illustrating the effect of (primary air/tertiary air) on NO and CO concentrations as measured at the exit (excess $O_2=1.5\%$) of the combustion tunnel;

FIGS. 12–12*d* is a series of three graphs illustrating the results of the detailed mapping of favorable flames as a function of distance from the burner (x-axis) and radial distance from the burner axis (y-axis): FIG. 12 temperature (K); FIG. 12*a* fuel concentration (mole fraction); FIG. 12*b* oxygen concentration (mole %); FIG. 12*c* $NO_x$ concentration; and FIG. 12*d* modified Richardson numbers;

FIG. 13 is a graph illustrating the effect of primary flue gas recirculation on $NO_x$ emission with the addition of steam in the fuel gas;

FIG. 14 is a graph illustrating the effect of primary and secondary flue gas recirculation on $NO_x$ emissions;

FIG. 15 is an alternative embodiment of the burner according to the invention.

STRUCTURE

Figure 1:
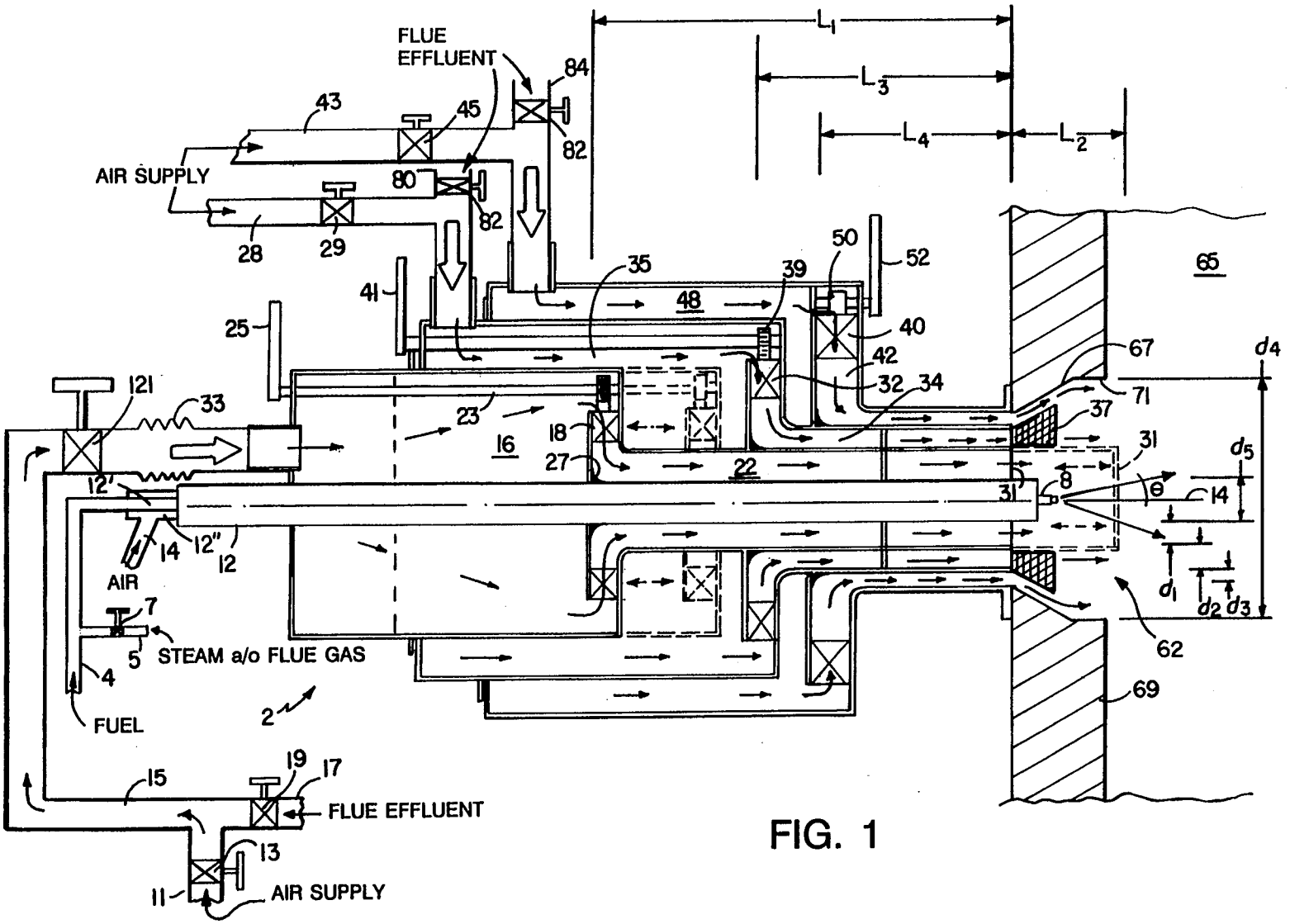
Figure 1A:
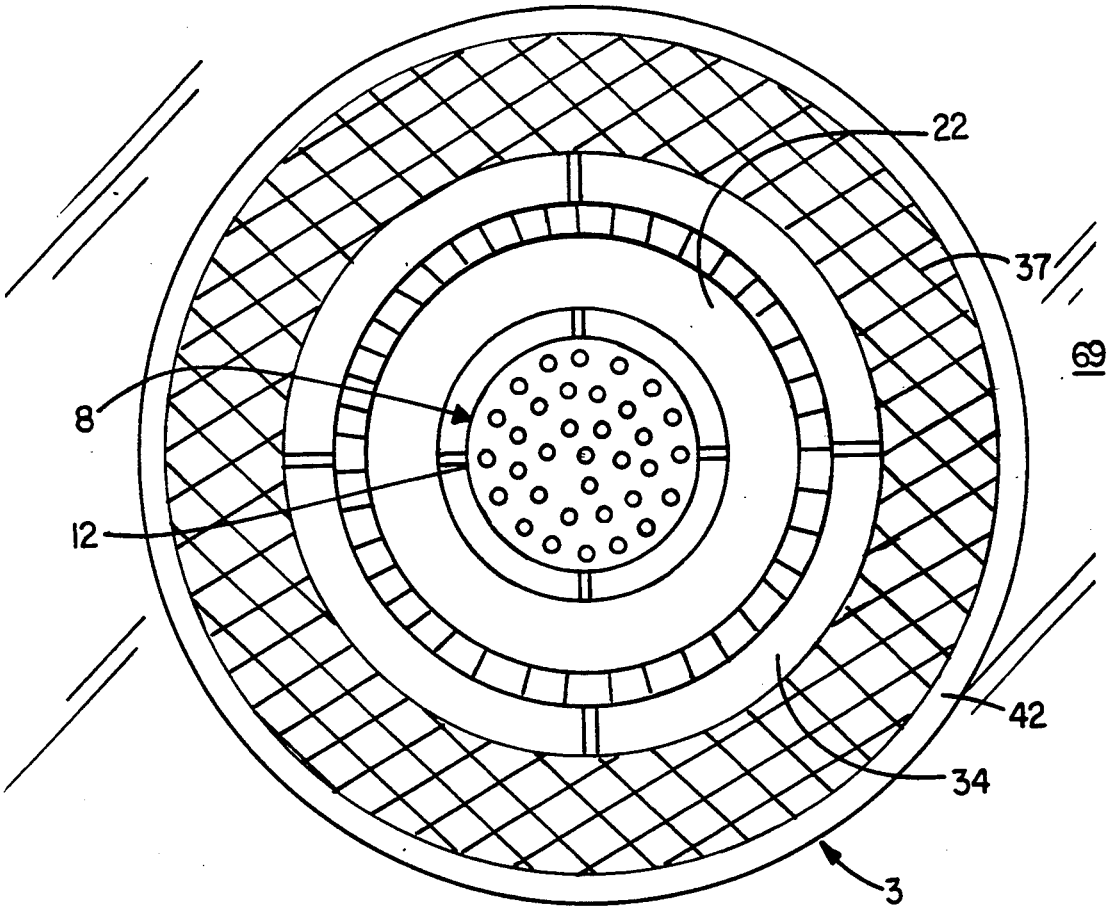

Referring to FIGS. 1 and 1*a*, a burner system 2 according to the invention in a preferred embodiment is capable of 1.5 mega-watt (about 5 million BTU per hour) output and includes a burner face 3 with three annular nozzle members 22, 34, 42 formed from concentric tubing for supply of combustion air and/or flue effluent flows about a fuel gun 12 positioned on the axis 14 of the burner. At the rear of the fuel gun, fuel enters a delivery pipe 4 which includes a steam and/or flue gas supply 5, having a valve 7 for controllably metering the steam and/or the flue gas as will be further discussed below. The fuel gun 12 also includes an inlet 4 which directs a flow of atomizing media, air or steam, into the gun 12. The gun is constructed of two internal concentric ducts 12', 12'' to effect a separation of the fuel and air along the length of travel of the gun. (For gaseous fuels such as natural gas atomizing medium is typically not employed). FIG. 1*a* shows the burner equipped with a nozzle adapted for natural gas. For fuel oil fuel an atomizing medium may be emitted concentrically (the fuel may be the inner or outer flow with respect to the air) as further discussed below into the burner quarl 62 and combustion chamber 65 from the end of the gun through spray nozzle 8 which forms a finely atomized stream of a combustible flow. In preferred embodiments, the nozzle 8 is arranged to provide a relatively narrow cone that inhibits substantial mixing of the combustible mixture with the atmosphere within the quarl 62 and chamber 65 for producing fuel rich combustion within and close to the quarl (the near field region) which leads to low $NO_x$ emissions. Preferably, the cone is of a half angle $\Theta$ of less than about 30 degrees, more preferably, less than 20 degrees. The fuel gun is axially moveable. The burner fuel gun is adapted for the injection of gaseous and the atomized injection of liquid or solid fuel including fuels with high nitrogen content, e.g., No. 2 or No. 6 fuel oil (the latter typically 0.53 weight percent nitrogen) and pulverized coal (typically 1.5 weight percent nitrogen) or coal-water slurries (typically 1% or higher). The gun body (stainless steel) is tubular in form and has a diameter of $d_5$, about 2.87 inches.

Figures 1B, 1C, 1D:
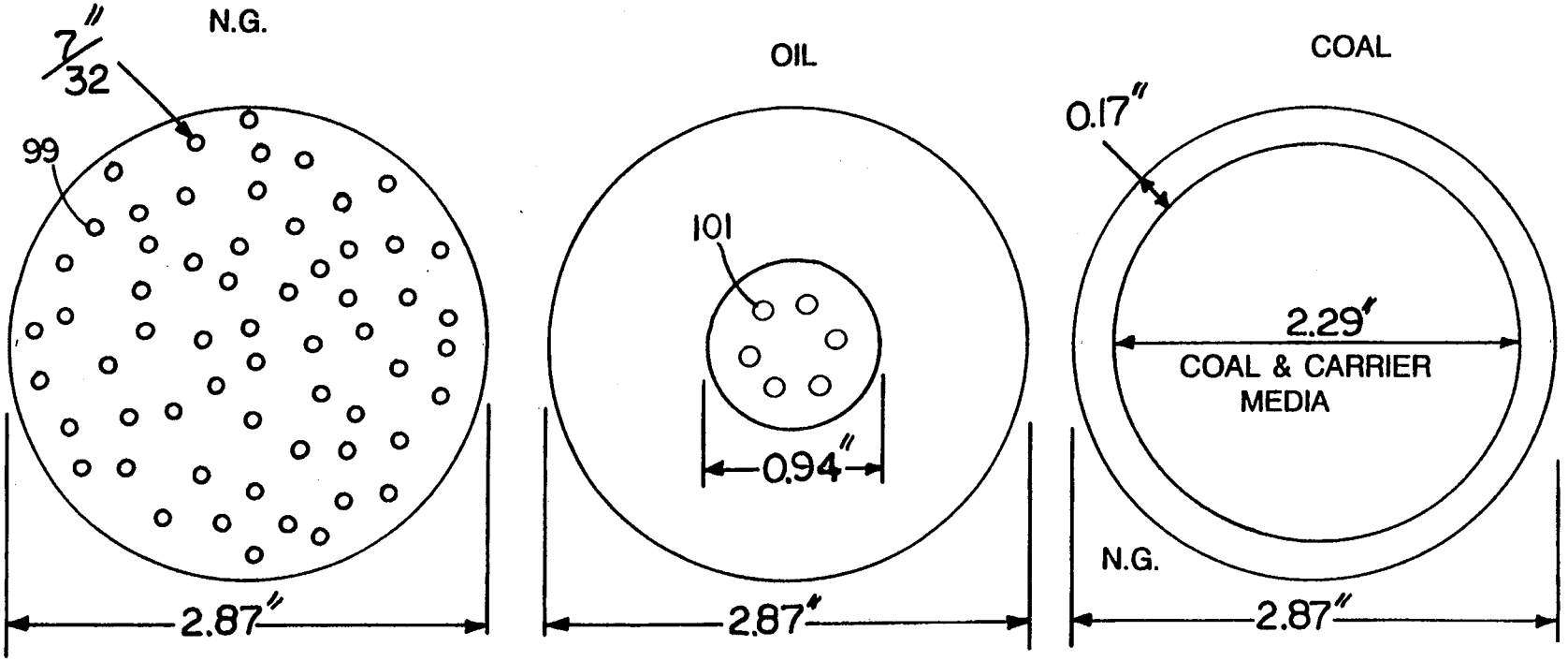

Referring to FIGS. 1*b–d*, preferred nozzle designs for gas, oil and coal respectively are shown. In FIG. 1*b*, for gas the nozzle includes a plurality of holes 99 of about 0.22 inches. The outer diameter of the nozzle is equal to the diameter of the gun. The flow is directed parallel to the axis of the burner. In FIG. 1*c*, for oil, the nozzle has a diameter of about 0.94 inches and includes a series of six apertures 101 (diameter about 0.52 inch) from which fuel and atomizing media are introduced into the combustion chamber at an angle of approximately 0° to 25° divergent half angle with respect to the burner axis. A nozzle of this type is useful as well with coal-water fuels. In FIG. 1*d*, for pulverized coal, the nozzle consists of two concentrically arranged tubes, wherein the coal and a carrier medium (e.g., air, flue gas and/or steam) is introduced through the central tube and natural gas for the ignition of the coal passed through the outer annular gap. The inner diameter of the central tube is about 2.29 inch and the width of the gap is about 0.17 inch.

Referring back to FIGS. 1 and 1*a*, concentrically arranged about the gun 12 is the primary flow nozzle 22, formed of a duct work in the form of a stainless steel or refractory material tube (diameter 6.5 inches). An annular gap of $d_1$ (about 2.87 inches) is thereby produced by the concentric arrangement. Air flow is provided from a supply to a tubing 11 and may be separately metered using valve 13. In addition, flue effluent may be introduced through piping 17 which similarly may be metered by valve 19 for positively controllable flow into the main supply tube 15. The use of small amounts of flue effluent in the primary air, secondary air and/or tertiary air flow is a particular aspect of this invention for reducing $NO_x$ emissions as will be further discussed below. The flow in the primary supply pipe 15 may be further controlled by valve 21. The flow through valve 21, enters a chamber 16 and flows through an adjustable, movable block-type swirler 18 to create a toroidal vortex as the gas flows through the gap of nozzle 22. The swirlers 18 can be adjusted by a lever adjustment means 23 which extends from within the chamber 16 to a handle 25 outside the chamber for easy access. Block-type adjustable swirlers enable the swirl number to be varied, for example between about 0 to 2.8. Swirlers of this type are available from International Flame Research Foundation, Holland and discussed in Beér and Chigier, *Combustion Aerodynamics,* Krieger Publishing, 1983, Malabor, Fla. It will be understood that other types of swirl generators such as stationary vane-type swirlers or tangential flow types might be employed in some embodiments. After exiting the swirler, the primary flow is guided into the nozzle 22 by means of a baffle 27.

The position of the end 31 of the primary flow nozzle 22 is made slidably adjustable with respect to the fuel gun 12 and the secondary 34 and tertiary 42 nozzles. As shown in FIG. 1, solid, the outlet end 31 of the primary nozzle may be positioned behind the gun nozzle 8, e.g., about 3 inches. The end of the primary nozzle 22 may also be extended to a point downstream of the fuel nozzle 8 as shown in phantom. The length of the primary nozzle 22 is $L_1$, about 30 inches, and the length of travel is $L_2$, about 5 to 6 inches (to a point just beyond the quarl). The gas supply pipe 15 may include a means such as bellows 33 (or a length of flexible tubing) enabling easy extension for adjustment of the primary nozzle position.

Concentrically arranged with respect to the primary nozzle is secondary nozzle 34, formed of a duct work tube (diameter, about 9.25 inches). The width of the annular gap of the nozzle 34 formed by the concentric arrangement is $d_2$, about $1\frac{3}{8}$ inches. The air flow for the secondary nozzle is provided through a supply pipe 28 positively metered by a valve 29. In addition or instead of air, flue effluent may be introduced through piping 80 which similarly may be metered by valve 82 for positively controllable flow. The flow enters a chamber region 35 before treatment with an adjustable block swirler 32 (swirl value 0 to 1.90) and entry into the nozzle area 34 having a length $L_3$ about 18 inches. The chamber 35 is constructed to accommodate the slidably axial motion of the chamber 16 that feeds the primary nozzle 22. The block swirler 32 may be controlled by means of a controller 39 which is accessed by handle means 41 held outside the burner structure.

Concentrically arranged with respect to the secondary nozzle is tertiary nozzle 42 formed from duct work to produce an annular nozzle gap having a width $d_3$, about 0.875 inches. Air is provided to the tertiary nozzle through a supply pipe 43 and may be controlled by a valve 45 to meter flow volume into the chamber 48 before treatment by the block type swirler 40 (swirl value of 0 to 1.39) which as before may be adjusted with the adjusting means 50, accessed by the handle 52. In addition, flue effluent may be introduced into the tertiary nozzle through piping either instead of the air or to be mixed with the tertiary air. The flue effluent may be metered by valve 86 for positively controllable flow with the main supply take 84. The length of flow of the air in the nozzle 42 is $L_4$, approximately 12 inches. The width of the burner quarl is $d_4$, approximately 17 inches.

For a 1.5 mega-watt burner, the flow rate of combustion air in the individual air supplies is typically 15 to 80 lbs/min and is separately metered through the primary, secondary and tertiary nozzles. The flow rate through the fuel nozzle is selected above that at which unstable flames occur and below that producing excessive rates of mixing of the auxiliary air with the fuel to occur. Preferably velocities are about less than 100 m/sec, e.g., 20–50 m/sec.

THEORY AND OPERATION

Nitrogen oxides formation in flames occurs by three main processes. The oxygen fixation of atmospheric nitrogen at high temperatures ("thermal $NO_x$" or "zeldovich $NO_x$"), secondly the nitrogen fixation by hydrocarbons to form HCN which leads to $NO_x$ formation through reaction with oxygen ("prompt $NO_x$") and thirdly the oxidation of organically bound nitrogen in the fuel ("fuel $NO_x$") in oxidizing atmospheres.

Figure 2:
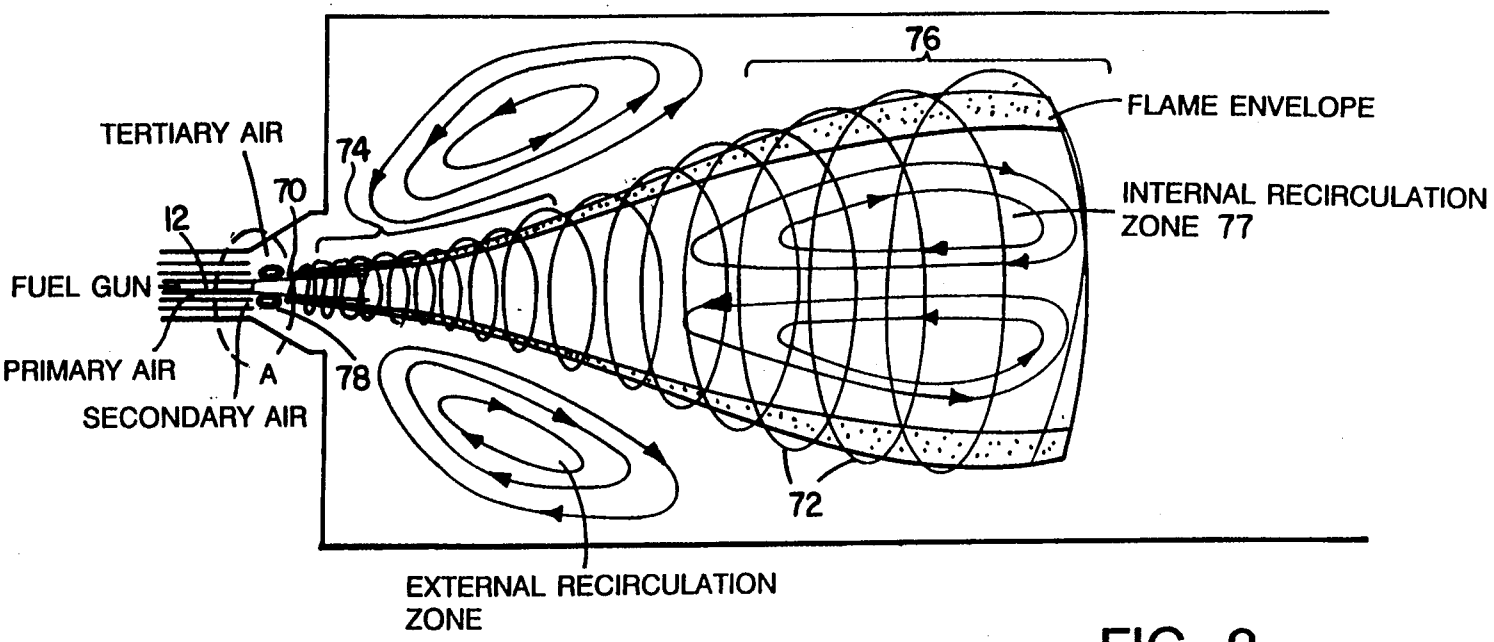

Referring to FIG. 2, in one preferred mode (mode 1, hereinafter) of operation of the burner particularly useful for natural gas, the majority of the air flow is provided through the secondary air supply. The burner creates a fluid dynamic flow pattern that enables low $NO_x$ production by combustion in two zones, from a single injection point. The flow 70 of the combustible gas mixture provided from the fuel gun 12 is radially stratified by the swirling vortex 72 created by the combination of controlled air flows from the primary, secondary and tertiary nozzles. The vortex limits mixing of the fuel with the oxidant mixture and provides a barrier to mixing of the combustible mixture with the bulk of the combustion air in the quarl and the combustion chamber near the burner face. The fuel is injected within the vortex as a narrow axial jet which enhances the richness of the fuel/air mixture near the fumier fuel. Thus, combustion in a first zone 74, in the near field close to the burner quarl is fuel-rich, inhibiting the production of $NO_x$ by limiting the available oxygen and enhancing the destruction of $NO_x$ that may diffuse from flame lean zones. Little or no $NO_x$ is formed in this region because of the reactions of hydrocarbon fragments with any $NO_x$ that may form.

Downstream of the fuel rich zone, the dynamics of the flow creates an internal recirculation zone 76 characterized by internal recirculation 77 which is fuel-lean but combustion-product rich, i.e., of low oxygen content. In this latter region, the combustion is completed under the low oxygen content conditions (e.g., generally about 2%). The products of the fuel rich flame zone mix gradually with the rest of the combustion air in the toroidal recirculation zone produced by the strong rotation of the air issuing through the annular air nozzles of the burner. In this latter flame zone combustion proceeds to completion.

Heat extraction from the fuel lean flame by thermal radiation, produces a flame temperature that avoids hot spots and is maintained at a moderate level, below about 1850K, typically about 1700K (a low temperature for the formation of thermal $NO_x$).

The rotating swirl flow thus fulfills two functions: (1) it stratifies the flow field at the interface of the burning fuel and the air by damping turbulence due to the interaction of a strong radial density gradient, i.e., a low density (hotter) flame in the center surrounded by high density (colder) air flowing in a toroidal fashion, and (2) the creation of a toroidal recirculation zone further downstream of the burner, a zone in which the residual fuel is burned completely. As discussed, stratification is a function of both swirl and density. As illustrated in the enlarged portion, FIG. 2*a*, small circulation zones 78 may occur near the burner exit, prior to combustion, which provide mixing of the primary concentric flow and the fuel. Downstream in the region of combustion, the density of the core is reduced by the combustion and the flows become stratified as discussed.

Figure 2A:
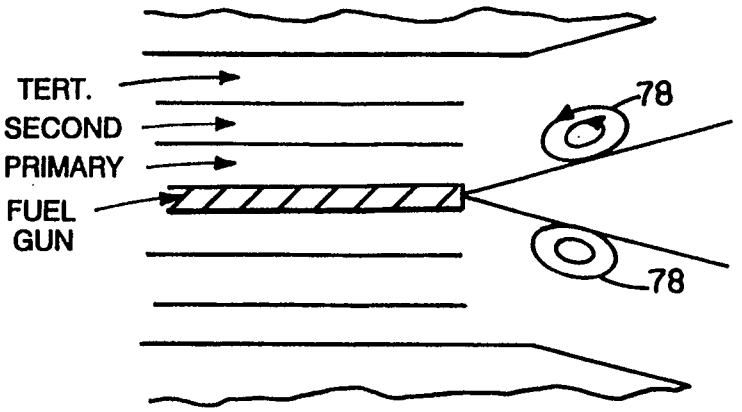
FIG. 2*a* is an enlarged view of the rerion A in FIG. 2
Figure 2B:
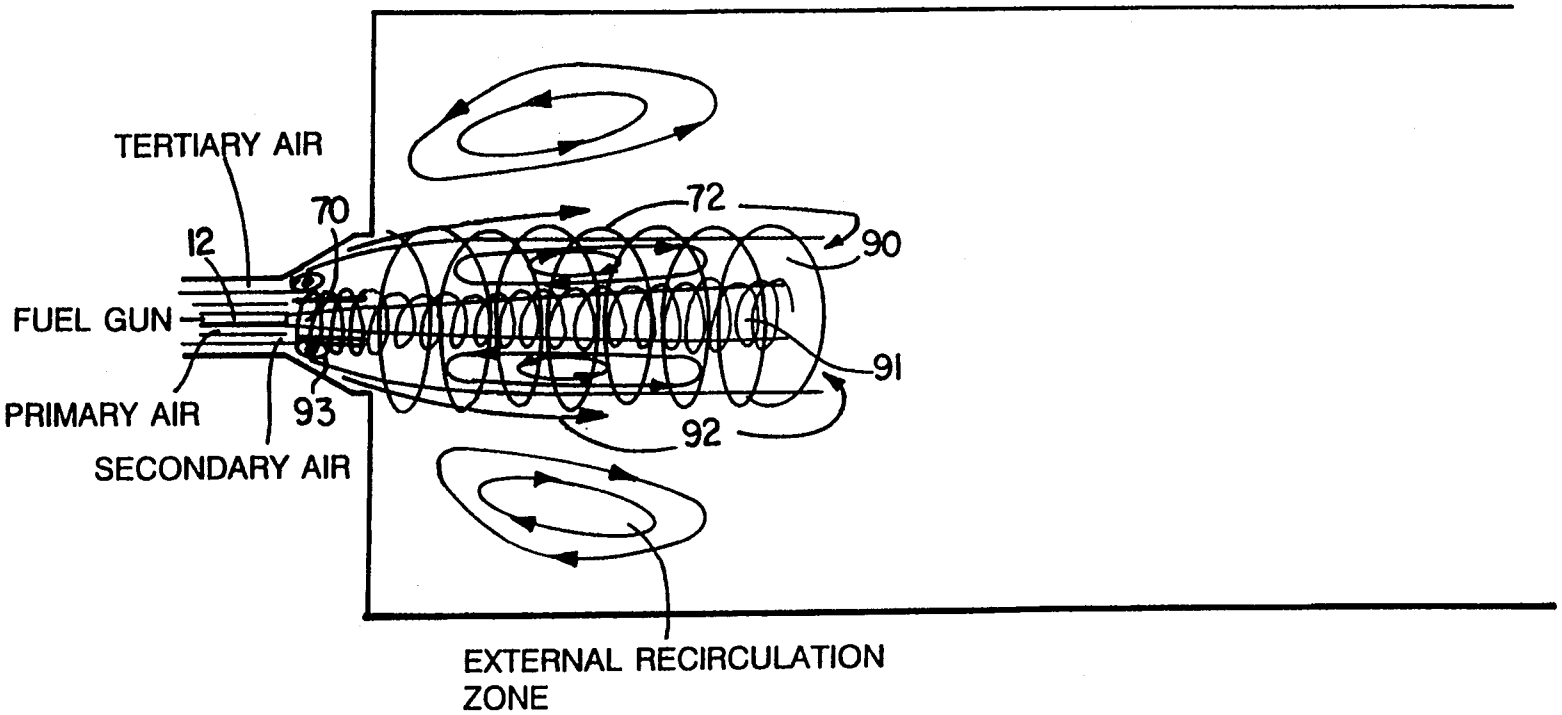
FIG. 2*b* is a gas flow schematic of the burner operated in another preferred configuration.

Referring to FIG. 2*b*, in another preferred mode (mode 2, hereinafter) of operation, particularly useful for natural gas, oil or coal, the majority of the air is provided through the tertiary nozzle. In this case the combustion mixture flow 70 is entrained in a vortex 72, as in the case of FIG. 2; however the envelope is wider in the near field region, resulting in a "bushy" flame. Within the flame envelope, a recirculation zone 90 of flame effluent is sandwiched between the fuel-rich flame core and the lean tertiary air zone, therefore limiting the mixing of the fuel rich region 91 and the tertiary combustion air 92. Further, recirculation of the effluent close to the burner face reduces oxygen content leading to low $NO_x$ production, as discussed. (The external recirculation zone illustrated in FIGS. 2–2*a* is a result of the confinement of the air and fuel within the combustion chamber.) As discussed, small circulation zones 93 may occur near the burner outlet.

The burner as described with respect to FIG. 1 enables fluid dynamics for creating fuel-air mixing as discussed above by a combination of narrow angle axial fuel jets and carefully controlled air flow of specified swirl velocity distribution surrounding the fuel jet. It is also a particular aspect of the invention that the flow from the primary, secondary and tertiary nozzles is positively and separately controllable from a position upstream of the swirlers to enable creation and tuning of the fluid dynamics leading to low $NO_x$ emission and is therefore not susceptible to variations in flow rate and volume created by local pressure variations in the combustion chamber. In addition, by variously controlling all of the flows as discussed, the length of the flame in the burner chamber can be controlled.

The burner is also equipped for the introduction of flue gas recirculated from either the combustion chamber or from positions in the flue gas duct between the combustion chamber and the stack. By the admixing of recirculated flue gas, the $O_2$ concentration of the oxidant air is depleted and the flame temperature is reduced, with the consequence of further reduction in the $NO_x$ emission. The multi-annular design of the burner makes it possible to reduce the amount of flue gas necessary for the effective reduction of the $NO_x$ emission because it permits aiming the flue gas into a critical flame region by its introduction through one or more of the annular nozzles specially selected for this purpose (e.g., the nozzle immediately surrounding the fuel jet).

The burner is also equipped with provision for steam and/or flue gas injection into the fuel stream. Dilution of the fuel concentration with steam or flue gas in the central axial flow fuel jet can produce further reductions in $NO_x$ emission. It has been observed experimentally that by admixing a small amount of steam with natural gas prior to injection of fuel into the furnace $NO_x$ emission levels dropped by more than 70%.

The low oxygen levels e.g., less than 4% excess $O_2$, less than about 20% total excess air, enable higher efficiency, lower waste gas heat loss since less nitrogen from the air source is heated and in addition high oxygen levels are known to result in increased opacity and corrosiveness in the burner effluent due to the transformation of $SO_2 \rightarrow SO_3$ leading to the formation of sulfuric acid. In the operation particularly for systems adapted for pulverized coal, or coal-water slurries, the excess oxygen level is maintained below about 4%. High carbon burnout e.g., about 99.5%, for pulverized coal and coal-water slurries have been achieved. For heavy fuel oil, e.g., no. 6 fuel oil the excess oxygen level is preferably below about 2%. For natural gas the use of low oxygen levels, 1% or lower, does not produce excessive CO levels, i.e., generally about 50 ppm or lower.

The burner as described enables the following features:

(1) Variable air flow distribution at the burner exit through the division of the flow rate into several concentric annular nozzles and the positive and separate control of air flow to each individual annulus.

(2) Variable control of the swirl degree of the air flow in the individual annular nozzles.

(3) Central fuel gun to inject the fuel in the form of narrow-angle axial jets.

(4) The injection of flue gas recirculated from a point between the combustion chamber and the stack through an individual burner annulus or annuli.

(5) Burner operation in a mode whereby the flame close to the burner is starved of air (it is fuel rich) by virtue of stratification brought about by combination of rotating flow and strong radial density gradient in the flame.

(6) Burner operation in a mode whereby the fuel rich flame zone referred to under feature (5) is followed by a region of internal toroidal recirculation in the flame. This latter flame region is fuel lean; combustion is completed in this second fuel lean flame zone with low rate of $NO_x$ formation.

(7) The low $NO_x$ levels obtainable by the burner operated, for example, in the mode described in paragraphs 5 and 6 can be further reduced by flue gas addition through one or more of the burner annuli. By depleting the $O_2$ concentration through the admixing of the flue gas to the combustion air or the fuel the $NO_x$ formation rates are depressed. The annulus immediately surrounding the fuel gun can be chosen for an effective application of flue gas recirculation; such an application results in the reduction of the amount of flue gas necessary for the desired $NO_x$ emission reduction.

(8) Provision is made for the injection of steam; for example, an amount of up to about 20% of the fuel mass flow rate for the additional reduction of $NO_x$ emission (e.g., from 35 ppm to 14 ppm).

The following Examples are illustrative and characterize the operation of the burner.

EXAMPLES

Example 1

Parametric experimental studies with natural gas carried out in the flame tunnel of the MIT Combustion Research Facility (CRF) (full description in Beer et. al. "Laboratory Scale Study of the Combustion of Coal—Derived Liquid Fuels", *EPRI Report* AP4038, 1985.) permitted characterization of the burner for low $NO_x$ and CO emissions by determining conditions for the radial distributions of the air flow and the swirl value at the exit from the burner and for the central fuel injection velocity and angle. The heat input was about 1.0 MW thermal and combustion air was preheated to 450° F. Briefly, the MIT Combustion Research Facility was designed to permit detailed in-flame measurements of the flow field and spatial distributions of temperature and chemical species concentrations to be made. The variable heat extraction along the flame by the use of completely and partially water cooled furnace sections-enables the close simulation of large scale flame systems to be made. Access to the flame by optical or probe measurements is provided by a 1.0 m long slot at the burner and at every 30 cm length further downstream along the flame tunnel. Measurements made at the "end" of the combustion tunnel are about 6 m from the burner face. Input variables such as the fuel and air flows, and the air preheat were maintained by automatic control at their set levels during the experiments. The distribution of air flow, and the swirl degree in the individual burner nozzles were hand controlled. The gas temperature distribution in the flames was measured by suction pyrometer and the CO, $CO_2$, and $NO_x$ concentrations of the gas, sampled at several points in the flame and in the exhaust, were determined by NDIR, (non-dispersive infrared paramagnetic and chemiluminescence continuous analyzers, respectively.

The ranges of values adopted during these experiments were:

| | |
|---|---|
| *Fuel jet velocity: | 50–600 ft/sec. |
| *Fuel jet angle: | 0°–25° |
| *Fuel gun position: | −45 (retracted) − 0 cm |
| *Primary air flow rate: | 0–100% |
| *Secondary air flow rate: | 0–100% |
| *Tertiary air flow rate: | 0–100% |
| *Swirl number of primary air: | 0–2.79 |
| *Swirl number of secondary air: | 0–1.90 |
| *Swirl number of tertiary air: | 0–1.39 |

In the parametric study, temperature and gaseous concentrations of CO, $CO_2$, $NO_x$ and $O_2$ were measured at the exit of the combustion tunnel.

The effects of burner input variables in 98 flames were investigated upon $NO_x$ and CO emissions from the combustion tunnel. The input variables found to have effect upon $NO_x$ and CO emissions are:

type of fuel nozzle
fuel gun position within burner
primary to tertiary air ratio
primary to secondary air ratio
radial displacement of swirl from flame axis The most significant input parameters affecting the $NO_x$ and CO emissions from the burner are the following:

the radial distribution of the swirl velocity at the burner exit,
The primary air flow as a fraction of the total air flow rate,
the axial position of the fuel gas introduction
Effect of Swirl The effect of the total air swirl, characterized by the swirl number, S, is shown in FIG. 3. The $NO_x$ emission drops to a low value of 82 ppm as the swirl number is maintained at about $S \sim 0.6$, which is the critical swirl number for the onset of the internal recirculation zone.

Of the vortex flow types produced with the variation of the radial distribution of the swirl velocity, the "Rankine" vortex was found to be the most favorable. In the rankine vortex the core of the rotating flow rotates as a solid body, with the swirl velocity increasing from the center linearly with radial distance to a maximum at the core boundary, from where it decreases hyperbolically with further increase of the radial distance. Referring to FIGS. 3*a* and 3*b*, graphs illustrating the effect of swirl number of other swirl conditions are shown. With the multi-annular burner it is possible to have different types of swirling flows produced by adjustment of the swirl of each of the concentric nozzles, using the block swirlers. The two extreme cases are the free and forced vortex swirling flows. Assuming a uniform axial velocity profile, free vortex swirling flow is obtained by imparting a high swirl to the primary air, low swirl to the secondary air and a zero swirl to the tertiary air. A forced vortex swirling flow is obtained by imparting a high swirl to the tertiary air, a lower swirl to the secondary air and a zero swirl to the primary air. In a Rankine-type vortex, the peak swirl level maximizes at some radial distance from the burner axis. To characterize the effect of the radial displacement of swirl of the combustion air from the flame axis, several model flames were generated by imparting varying swirl degrees to one of the primary, secondary and tertiary air nozzles (while having zero swirl in the other nozzles). The effect of this parameter on $NO_x$ concentration is illustrated in FIG. 3*a*. It is noteworthy, that the optimum configuration for a low $NO_x$ concentration was found for a Rankine vortex type swirl velocity distribution. The minimum values of $NO_x$ emissions shown in FIG. 3*a* can be further reduced by maintaining a swirl number of about 0.4 for primary air, 0.7 for secondary air and 0 for tertiary air (i.e., the minimal for each of the vortex types tested in FIG. 4*a*). As shown in FIG. 3*b*, this "optimum configuration" further reduces $NO_x$ emission to about 75 ppm without increasing significantly the CO emissions.

FIG. 4 refers to a correlation between the sum of the angular momenta of the primary, secondary and tertiary air flows each weighted by its normalized radial distance from the burner axis, and the $NO_x$ emission is illustrated. However, not all the cases shown to give minimum $NO_x$ emission are practicable because some of these result in excessive CO emission and combustion length. A correction for the high CO emission could be made by the additional adjustment of the axial position of the fuel gas nozzle.

Fuel Gun Position

The axial position at which the fuel is introduced within the burner is important in determining the flame structure. Fluid dynamically it affects the interaction of the axial fuel jet and the swirling annular air flow. To investigate the effect of this parameter upon $NO_x$ and CO emissions, several flames were investigated in which the location of injection of fuel within the burner was varied. FIG. 5 and 6 (mode 2) illustrate the effect of this variable for the cases of highly swirling and weakly swirling primary air. The negative values of the fuel gun positions shown in FIGS. 5 and 6 indicate the distance between the end of the burner face and the fuel gun nozzle tip. A negative value implies that the gun has been retracted into the burner throat. The data shows that the fuel gun position has little effect upon $NO_x$ emission level. However, CO concentration has been observed to increase dramatically when the fuel gun was moved in the burner if the primary and secondary air fractions were low and the overall swirl number is low (FIG. 6). On the other hand, when the primary air fraction is relatively high (e.g., about 50%) CO emissions are insensitive to the gun position (FIG. 5).

Type of Fuel Nozzle

Two parameters, the exit velocity of the fuel jet from the gun and the angle of the jet relative to the flame axis, were considered in the design of the fuel nozzles. Several nozzles were built to allow the velocity of the fuel to range from 50 ft/sec. to 600 ft/sec. and the angle to vary from 0° to 25°. Results obtained from the combustion tests with these nozzles are shown in FIGS. 7 (mode 1, flow velocity variation) and 7*a* (mode 2, flow velocity variation) and 8 (angular variation). It is noteworthy that while CO emission levels were very low for all cases they were increasing slightly with increasing fuel jet velocity regardless of mode 1 or mode 2 operation. On the other hand, $NO_x$ emission levels were influenced by the fuel jet velocity: i.e., for mode 1 (FIG. 7) $NO_x$ concentration increased by more than 100%. For mode 2 (FIG. 7*a*), the $NO_x$ concentration was insensitive. Further, increasing the fuel jet angle from 0° to 25° increased $NO_x$ concentration at the exit by ~25% (FIG. 8). The same effect is observed for mode 1 flames.

Primary Air Fraction

FIG. 9 shows a monotonic increase in $NO_x$ emission with increasing primary air fraction. An increase flow rate of primary air can be seen to promote early fuel-air mixing and $NO_x$ formation in the flame. It is noteworthy, however, that the reduction in primary air flow did not increase CO emission from the flame.

The conditions represented in FIG. 5 with 51% of the air supplied as primary air give higher $NO_x$ values, ranging from 110 to 135 ppm, while CO concentrations are low because of the early aeration of the fuel in this case. In the case illustrated in FIG. 6, the primary air fraction is 10% and the $NO_x$ levels are in the range of 75 to 85 ppm which shows that even at a low level of swirl degree in the primary air, fuel/air mixing is damped in the near field. However, as the primary air fraction is raised as illustrated in FIGS. 10 and 11, $NO_x$ emission levels increase indicating the early mixing of the fuel with the combustion air. It is noteworthy that for the cases which have low primary air fraction, the lean stage mixing further downstream is inefficient without strong swirl in the tertiary air. For the condition of high degree of swirl of the primary air, $NO_x$ concentration is mainly dependent upon the primary air fraction. The CO emissions, however, are more dependent upon the swirl degree of the secondary and/or tertiary air. For the cases in FIG. 11, the CO concentration remains virtually constant over the full range of primary flow fraction as long as the tertiary air has a high degree of swirl (S=1.32). The flame conditions chosen for detailed experimental characterization reflect the above trends: low primary air fraction (19.3%) with high swirl (S=2.79), high secondary mass flow fraction (62%) with over critical degree of swirl (S=0.85), and low tertiary air flow (18.7%) with no swirl, ($NO_x$ emission at 3% O2: 70 ppm; CO: 56 ppm and the O2 concentration in the exhaust:1.85%).

Similarly favorable conditions may also be obtained with low primary, low secondary and high tertiary air flows as long as swirl is imparted both to the primary and the tertiary air flows.

Detailed Flame Characterization

After the conclusion of the parametric experiments, one of the favorable burner configurations was chosen for detailed flame characterization by in-flame probe measurements. The input burner conditions maintained for this flame are listed in Table I. In the detailed flame study radial and axial in-flame measurements were made of gas velocity, gas temperature and gaseous species concentration (CO, $CO_2$, $NO_x$, $C_nH_m$ and $O_2$ distributions).

TABLE I

Burner Configuration and Exit Gas Composition for the Optimum Flame

| | Percent | Swirl No. |
|---|---|---|
| primary air | 19.3 | 2.79 |
| secondary air | 62 | .85 |
| tertiary air | 18.7 | 0 |
| fuel velocity | 50 ft/sec | |
| | As measured | 3% $O_2$ |
| $O_2$ | 1.85% | — |
| CO | 60 ppm | 56 ppm |
| NO | 74 ppm | 70 ppm |

In this favorable flame configuration $NO_x$ and CO emissions were low. In this flame, 62% of the air mass flow rate was introduced through the secondary air port, with the remainder equally divided by the primary air and tertiary air supplies. The overall swirl number maintained was 0.75 and it is of the Rankine vortex type. Temperature isotherms and iso-concentration lines of $CH_4$ and $O_2$ shown in FIG. **12–12*b*** illustrate the effectiveness of this burner configuration in staging the flame.

The iso concentration lines of $CH_4$ and $O_2$ indicate that the fuel was effectively separated from the combustion air and the mixing rate between the two was low. This is reflected by the gradual increase of temperature over a large distance (~1 meter) from the burner inlet. The slow rate of mixing is a result of damping of turbulence through the stratification of the flow by the high swirl imported to both the primary and secondary air jets. As a result of this process, the energy release from the oxidation of fuel is gradual and therefore a relatively low peak flame temperature (1800 K) was obtained consequently, $NO_x$ formation was inhibited in this flame (see FIG. **12*c***).

FIG. **12*d*** illustrates the distribution of the modified Richardson number, defined earlier, in the "optimum" natural gas flame. The Ri* values were calculated from measurements of velocity and temperature (density) distributions in the flame. Stratification begins when Ri* >0.04. As can be seen in the Ri* distribution plotted in FIG. **12*d*** flame stratification was effective for maintaining a fuel rich flame core.

Summary

The results of the above characterizations indicate that the preferred operational burner variables for low $NO_x$ emission fall within the following ranges:

(1) Fuel $CH_4$ jet velocity: 50 to 100 ft/s (2) Fuel jet half angle ~10° or less (3) Fuel gun position: to be retracted within the burner by about 15 cm to prevent overheating the fuel gun and to reduce CO emission (4) Mass flow and swirl velocity distributions: Two favorable modes (mode 1 and mode 2) of operation may be employed: In both these cases the primary air fraction was low (1–20%) and the primary air had high swirl degree ranging from S=0.4 to 2.9. The rest of the combustion air could then be divided between secondary and tertiary nozzles: Secondary air: 62%, S=0.84 and higher with the rest of the air as unswirled tertiary air; or low secondary air (only the air necessary to cool the nozzle, about 10%) and 70–90% of Tertiary air with high swirl (S=1.32). Both these cases lead to radial stratification of the flame close to the burner and to development of the toroidal recirculation zone necessary to good carbon burn-out.

By maintaining the above conditions emission levels of about 70 ppm $NO_x$ (at 3% $O_2$ and 60 ppm CO could be obtained in stable operation.

Example 2

Experiments were also conducted with No. 2 and No. 6 oil. Experiments were also conducted with pulverized coal with 1.5% fuel nitrogen and coal-water fuel with 1% fuel nitrogen. The preferred mode of operation was that of a mode 2 type flame. The burner $NO_x$ emission was in the range of about 85 ppm for No. 6 oil with 0.53% fuel nitrogen. As for No. 2 oil, the emission of $NO_x$ was observed to be about 40 ppm. For both fuels the CO emission levels were lower than 40 ppm. For coal and coal-water fuel, $NO_x$ emission levels of about 200 ppm were achieved.

The optimization of parameters may be determined as discussed above with respect to natural gas. Preferred parameters are:

| | |
|---|---|
| Fuel jet velocity: | about 200 ft/sec |
| Fuel jet angle: | 10° or less |
| Fuel gun position: | retracted |
| Mass flow and swirl combustion air distribution: | 1–20%, preferably 10% primary; 1–20%, preferably 10% secondary; 70–90% tertiary. The air swirl number is preferably: primary - about 0.5 to 2.8; secondary - about 0.5 to 2.0; tertiary - about 1.5 or less |

When using recirculated flue gas in the concentric nozzles, the following is preferable:

| | |
|---|---|
| Burner gas recirculation distribution: | 5–30% preferably 10% primary; 5–30% preferably 20% secondary; 70–90% tertiary. The gas swirl number is preferably: primary about 0.5–2.8; secondary about 0.5–2.0; tertiary about 1.5 or less. |

Example 3

Reduction of $NO_x$ by flue gas recirculation and the dilution of the fuel gas by steam.

Recirculation of flue gas through the burner may reduce $NO_x$ formation by two mechanisms. Firstly, the increased volume flow rate of gas through the flame reduces the adiabatic flame temperature, and secondly, the large inert content ($CO_2$, $H_2O$ and $N_2$) of the flue gas which depletes the $O_2$ concentration of the flame gases decreases the rate of NO formation. Deteriorating flame stability (lifted flame and blow off) is normally limiting the amount of recirculation before economic considerations of increased costs of ducting and pumping energy show diminishing returns.

The multi-annular design of the burner taught herein permits flue gas to be recirculated through any or all of the burner nozzles. By introducing the flue gas through the primary and secondary air nozzle the effect on the fuel/air interface is accentuated and a smaller amount of recirculated gas is needed to achieve the same extent of $NO_x$ reduction.

The high flame stability of the design is also favorable for allowing reduced $O_2$ concentration of the oxidant surrounding the fuel gas jet. In the present burner a fan capable of recirculating 1500° F. temperature flue gas from the post combustion region of the flame tunnel has been used and arrangements were made to inject the recirculated flue gas through the burner compartments serving also for the introduction of the primary and secondary air flows.

FIG. 13 shows results of $NO_x$ emission in the burner flames starting aerodynamically optimized flames (flame type 1) (70 ppm $NO_x$) and increasing the flue gas recirculation in the primary air compartment of the burner up to 16% of the total flue gas flow rate. The $NO_x$ reduction was even greater when, concurrently, steam (0.12 lb/lb fuel gas) was injected into the fuel gas. In some cases where steam is applied to the fuel flow, the amount of flue gas recirculated may be decreased without increasing $NO_x$ emission.

Because of the good flame stability it was possible to increase further the flue gas recirculation while maintaining the 0.12 steam/natural gas ratio. The $NO_x$ emission can be seen in FIG. 14 to drop to 15 ppm (at 3% $O_2$) for a recirculation ratio of 32%. The high rates of recirculation make the flame non-luminous. No increase in flame length or CO emission was found, very likely because of the increased momentum of the gas flows which made their positive contribution to improved mixing in the fuel lean burn-out zone of the flame.

Other embodiments

In other embodiments, flue effluent may be introduced and metered into any and all of the primary, secondary and tertiary flows or mixed with the fuel.

Low $NO_x$ combustion can be effected by advantageous design of the outlet of the burner system. In FIG. 15, a system is shown wherein all flows are directed in a parallel manner with respect to the burner axis. The burner block 69 directs flows from the secondary and tertiary nozzles parallel to the burner axis.

The burner may be scaled for any size output from, for example, residential burners to large utility burners of, e.g., 200 million BTU. Dimensions and flows can be selected from the teachings herein, for example using computer models such as the "Fluent" program available from Creari, Inc., Hanover, N.H.

Other embodiments are in the following claims.

What we claim is:

1. A method for low $NO_x$-emission burning of a fuel, comprising:

providing a burner having a chamber with an insertion region, said insertion region including a low divergence fuel nozzle arranged on a burner axis, and first, second and third concentric nozzles, each said nozzle arranged at increasing radii from said axis and arranged to introduce flow to said chamber from substantially the same axial location, flowing a combustible fuel through said fuel nozzle to form a combustible fuel flow along said axis;

providing a concentric flow formed by first, second and third successively concentric component flows, including oxidant gases, through said first, second and third concentric nozzles;

stratifying said fuel flow and concentric flow to limit mixing of oxidant gases with said fuel flow to maintain a high-temperature fuel rich core zone near said insertion region and to induce mixing with oxidant gases in a lower temperature recirculation zone spaced from said insertion region, said stratifying being achieved by providing the combination of a radial density gradient from low density, high temperature in said core zone close to the axis to higher density, lower temperature spaced radially from said core and swirling said concentric flow, controlling said swirling such that the first concentric flow comprises a fraction of about 0.2 or less of the total concentric flow and the swirl number of said first flow is higher than the swirl number of the second and third flows, pyrolizing said fuel in said high-temperature fuel-rich core zone near said insertion region, where the mixing of oxidant gases with said fuel is limited by the stratifying, thereby limiting $NO_x$ formation in said high temperature fuel-rich zone; and combusting the product of said high temperature fuel-rich core zone in said lower-temperature recirculation zone spaced from said insertion region, where mixing of ambient gases is induced, and low-temperature combustion results in limited formation of $NO_x$.

2. The method of claim 1 wherein said first concentric component flow has a swirl velocity equal to or greater than said combustible fuel flow, said second concentric component flow has a swirl velocity equal to or less than the swirl velocity of said first concentric component flow and said third concentric component flow has a swirl velocity equal or less than said second concentric component flow.

3. The method of claim 1 comprising:

providing a first concentric component flow that is about 10 to 20% of the total concentric flow and has a swirl number of about 0.6 or greater, providing a second concentric component flow that is about 10 to 30% of the total concentric flow and has a swirl number of about 0.6 or greater, and providing a third concentric component flow that is about 40 to 80% of the total concentric flow and has a swirl number in the range of about 1.5 or less.

4. The method of claim 1, comprising:

providing a first concentric component flow that is about 10% of the total concentric flow and has a swirl number of about 0.6 or higher, providing a second concentric component flow that is about 10% of the total concentric flow and has a swirl number of about 0.60 or higher, and providing a third concentric component flow that is about 80% of the total concentric flow and has a swirl number of about 1.5 or less.

5. The method of claim 4 further comprising:

recirculating flue gas from said combustion by providing said flue gas to at least one of said concentric nozzles.

6. The method of claim 5 further comprising recirculating about 50% or less of said flue gas.

7. The method of claim 1 or 5 further comprising:

providing steam to said fuel flow.

8. The method of claim 7 wherein said steam is about 25% or less of said fuel flow.

9. The method of claim 1 further comprising:

controlling said stratifying to limit substantial mixing of ambient gases with said core zone where the temperature of said core zone is about 1700K or greater.

10. The method of claim 9 further comprising:
controlling said stratifying to induce mixing downstream of of said core zone in a recirculation zone having a temperature of about 1700K or less.

11. The method of claim 1 wherein said fuel is selected from the group consisting of gaseous hydrocarbon fuels, coal and fuel oils.

12. A burner for low $NO_x$-emission burning of fuels, comprising:
a chamber with an insertion region, said insertion region including:
a low divergence fuel nozzle arranged on an axis for providing a flow of a combustible fuel, and
a concentrically arranged first nozzle for providing a first concentric component flow about said combustible fuel flow,
a concentrically arranged second nozzle, for providing a second concentric component flow about said first component flow,
a concentrically arranged third nozzle for providing a third concentric component flow about said second component flow,
said nozzles arranged to introduce said fuel and first, second and third component flows to said chamber at substantially the same axial location,
a controller for stratifying to limit mixing of oxidant gases with said fuel flow to maintain a high-temperature fuel rich core zone near said insertion region and to induce mixing with oxidant gases in a lower temperature recirculation zone spaced from said insertion region,
said controller including a flow controller for controlling the amount of flow through said first, second and third nozzles, said flow controller set such that said first concentric flow comprises a fraction of about 0.2 or less of the total concentric flow,
said controller further including a swirl controller for controlling the swirl of said first, second and third concentric component flows, said swirl controller being set such that the swirl velocity of said first flow is higher than the swirl velocity of the second and third flows,
said concentric component flows, in combination with a radial density gradient from a low density high temperature in said core to higher density, lower temperature spaced radially from said core, effective to bring about a condition of stratification, whereby mixing of ambient gas with said combustible fuel flow is limited to maintain a high temperature fuel rich core zone near said insertion region and to induce mixing in a lower temperature recirculation zone spaced from the insertion region, and
an ignitor for initiating burning of said combustible fuel flow.

13. The burner of claim 12 wherein said swirl controller is constructed to provide said first concentric component flow that has a swirl velocity equal to or greater than said fuel flow, second concentric component flow that has a swirl velocity equal to or less than the swirl of said first concentric component flow and third concentric component flow that has a swirl equal or less than said second concentric component flow.

14. The method of claim 1 wherein said burner has a single insertion region, wherein all flows are introduced to the combustion chamber upstream of the core zone.

15. The burner of claim 13 wherein said swirl controller is constructed for providing a first concentric component flow that is about 10 to 20% of the total concentric flow and has a swirl number in the range of about 0.6 or greater,
a second concentric component flow that is about 10 to 30% of the total concentric flow and has a swirl number in the range of about 0.6 or greater, and
a third concentric component flow that is about 40 to 80% of the total concentric flow and has a swirl number in the range of 1.5 or less.

16. The burner of claim 15 wherein
said swirl controller provides a first concentric component flow that is about 10% of the total concentric flow and has a swirl number of about 0.6 or higher,
a second concentric component flow that is about 10% of the total concentric flow and has a swirl number of about 0.60 or higher, and
a third concentric component flow that is about 80% of the total concentric flow and has a swirl number of about 1.5 or lower.

17. The burner of claim 12 or 15 further comprising:
a recirculating fan for recirculating flue gas from said combustion and providing said flue gas to at least one of said concentric nozzles.

18. The burner of claim 17 wherein said recirculating fan is constructed for recirculating about 50% or less of said flue gas.

19. The burner of claim 12 or 15 further comprising a steam supply for providing steam to said fuel flow.

20. The burner of claim 19 comprising a meter constructed for controlling said core flow to provide about 25% or less steam in said fuel flow.

21. The burner of claim 12 further comprising flue gas supply for providing flue gas to said fuel flow.

22. The burner of claim 12 wherein said controller is constructed to stratify to limit substantial mixing of ambient gases with said core zone where the temperature of said core zone about 1700K or greater.

23. The burner of claim 22 wherein said controller is constructed to induce mixing downstream of said core zone in a recirculation zone having a temperature of about 1700K or less.

24. The burner of claim 12 further comprises a supply of fuel selected from the group consisting of gaseous hydrocarbon fuel, coal and fuel oils.

25. The burner of claim 12 wherein said fuel nozzle produces a combustible fuel flow with a half angle of about 30 degrees or less.

26. The burner of claim 25 wherein said fuel nozzle produces a combustible fuel flow with a half angle of about 20 degrees or less.

27. The burner of claim 12 wherein the flow rate of said first, second and third concentric component flows are separately adjustable.

28. The burner of claim 12 wherein the swirl numbers of said first, second and third concentric component flows are separately adjustable.

29. The burner of claim 12 wherein said burner has a single insertion region, wherein all flows are introduced to the combustion chamber upstream of the core zone.

30. A method for low $NO_x$-emission burning of a fuel, comprising the steps:
providing a fuel flow along an axis and a concentric flow, including oxidant gases, disposed about said fuel flow, said fuel flow and concentric flow being introduced into a chamber at substantially the same axial location at an insertion region, stratifying said fuel flow and concentric flow to limit mixing of oxidant gases with said fuel flow to maintain a high temperature fuel rich core zone near said insertion region and induce mixing with oxidant gases in a lower temperature recirculation zone spaced from said insertion region, said stratifying being achieved by providing the combination of a radial density gradient from low density, high temperature in said core zone close to said axis to higher density, lower temperature spaced radially from said core zone and swirling said concentric flow;

controlling said stratifying to limit mixing such that said fuel is substantially confined within a region about the core where the modified Richardson number of said concentric flow is about 0.04 or greater;

pyrolizing said fuel in the core in a high-temperature zone near said insertion region, where the mixing of ambient gases with said fuel in said core flow is limited, thereby limiting $NO_x$ in said high temperature zone; and combusting the product of said high temperature zone in a lower-temperature recirculation zone spaced from said insertion region, where mixing of oxidant gases and said fuel mixture is induced, and low-temperature combustion results in limited formation of $NO_x$.

31. The method of claim 30 comprising controlling said stratifying to limit mixing such that the mole fraction of fuel is about 0.20 or less in the region where said modified Richardson number of said swirling flow is about 0.04 or greater.

32. The method of claim 30 comprising controlling said stratifying to limit mixing such that the modified Richardson number increases with radial distance from said core to a value of about 0.80.

33. The method of claim 32 comprising controlling said mixing to limit mixing such that the mole fraction of fuel is about 0.10 or less in the region where the modified Richardson number of said swirling flow is about 0.80.

34. A method for low $NO_x$-emission burning of a fuel, comprising the steps:

providing a fuel flow along an axis and a stratifying flow, including oxidant gases, formed by multiple component flows concentrically disposed about said fuel flow, stratifying to limit mixing of oxidant gases with said fuel flow to maintain a high temperature fuel rich core zone near said insertion region and induce mixing in a lower temperature zone spaced from said insertion region, said stratifying being achieved by providing the combination of a radial density gradient from low density, high temperature in said core zone close to said axis to higher density, lower temperature spaced radially from said core zone and swirling said stratifying flow;

determining the degree of stratification by determining the modified Richardson number;

controlling the stratification to effect low NOx emission.

35. The method of any one of the claims 30–34, comprising controlling said stratifying by controlling the fraction and swirl number of said component flows.

36. The method of claim 35 comprising:

controlling said multiple component flows such that the component flow closest to said axis comprises a fraction of about 0.2 or less of the total stratifying flow.

37. The method of claim 36 comprising:

controlling said multiple component flows such that the component flow closest to the axis has a higher swirl number than the other component flows.

38. The method of claim 36 comprising:

providing first, second and third concentric successively concentric flows.

39. The method of claim 38 comprising:

controlling said multiple component flows such that said third flow is greater fraction of said total flow than either the first or second flow.

40. The method of claim 37 comprising:

controlling said multiple component flows such that the first flow, closest to the axis, and the second flow, adjacent the first flow, have a swirl number than the third flow.

41. The method of claim 30 or 34 comprising:

recirculating flue gas from said chamber through at least one of said component flows.

42. The method of claim 30 or 34 comprising:

providing steam to said fuel flow.

43. The method of claim 30 or 34 comprising:

providing said fuel flow through multiple ports arranged about the axis.

44. The method of claim 30 or 34 comprising:

providing a fuel flow including fuel oil.

45. The method of claim 30 or 34 comprising:

providing a fuel flow including coal.

46. The method of claim 30 or 34 comprising:

providing a fuel flow including a gaseous hydrocarbon.

* * * * *

UNITED STATES PATENT AND TRADEMARK OFFICE

CERTIFICATE OF CORRECTION

PATENT NO. : 5,411,394

DATED : May 2, 1995

INVENTOR(S) : James M. Beer, et al.

It is certified that error appears in the above-identified patent and that said Letters Patent is hereby corrected as shown below:

Cover page, under "FOREIGN PATENT DOCUMENTS" add --2724532 12/1978 Germany--

Col. 1, line 39, before "multi-annular" insert --pysically-separated--

Col. 16, claim 4, line 44, replace "1" with --3--

Signed and Sealed this

Twenty-eighth Day of May, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,411,394
DATED : May 2, 1995
INVENTOR(S) : Janos M. Beer, et al.

It is certified that error appears in the above-indentified patent and that said Letters Patent is hereby corrected as shown below:

Col. 1, line 39, before "multi-annular" insert --physically-separated--

Col. 17, claim 10, line 3, replace "of of" with --of--.

Signed and Sealed this

First Day of October, 1996

Bruce Lehman

*Attest:*

BRUCE LEHMAN

*Attesting Officer*

*Commissioner of Patents and Trademarks*